US011835883B2

(12) United States Patent
Sakamaki et al.

(10) Patent No.: US 11,835,883 B2
(45) Date of Patent: Dec. 5, 2023

(54) IMAGE FORMING APPARATUS CAPABLE OF REDUCING PERIODIC IMAGE DENSITY UNEVENNESS

(71) Applicant: CANON KABUSHIKI KAISHA, Tokyo (JP)

(72) Inventors: Tomoyuki Sakamaki, Tokyo (JP); Mitsuhiro Furukawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/818,233

(22) Filed: Aug. 8, 2022

(65) Prior Publication Data

US 2023/0046441 A1 Feb. 16, 2023

(30) Foreign Application Priority Data

Aug. 11, 2021 (JP) ..... 2021-131200

(51) Int. Cl.
*G03G 15/06* (2006.01)
*G03G 15/00* (2006.01)

(52) U.S. Cl.
CPC ..... *G03G 15/065* (2013.01); *G03G 15/5025* (2013.01)

(58) Field of Classification Search
CPC ..... G03G 15/065; G03G 15/5025
See application file for complete search history.

(56) References Cited

U.S. PATENT DOCUMENTS 10,274,865 B2 4/2019 Furuta et al.
2007/0116482 A1* 5/2007 Ichikawa ..... G03G 15/5058 399/49

FOREIGN PATENT DOCUMENTS

JP 2004109483 A 4/2004
JP 2017003767 A 1/2017
JP 2018063299 A 4/2018

OTHER PUBLICATIONS

Machine translation of JP2018063299 (Year: 2018).*

* cited by examiner

*Primary Examiner* — Walter L Lindsay, Jr.
*Assistant Examiner* — Andrew V Do
(74) *Attorney, Agent, or Firm* — Canon U.S.A., Inc. IP Division

(57) ABSTRACT

A controller is able to, in a case where the controller receives a correction instruction for image density, execute a phase detection mode for detecting a phase of an image bearing member and detecting a phase of a developer bearing member and change an image forming condition for an image forming unit during an image formation mode based on respective phases of the image bearing member and the developer bearing member detected in the phase detection mode and an image density of a toner pattern, and a ratio of a circumferential velocity of the developer bearing member to a circumferential velocity of the image bearing member during the phase detection mode is different from a ratio of a circumferential velocity of the developer bearing member to a circumferential velocity of the image bearing member during the image formation mode.

20 Claims, 19 Drawing Sheets

IMAGE FORMING APPARATUS CAPABLE OF REDUCING PERIODIC IMAGE DENSITY UNEVENNESS

BACKGROUND OF THE DISCLOSURE

Field of the Disclosure

Aspects of the present disclosure generally relate to an image forming apparatus equipped with a developing device which develops an electrostatic image formed on an image bearing member.

Description of the Related Art

Conventionally, with regard to an image forming apparatus of the electrophotographic type, there is known a method of visualizing, with a developing device, an electrostatic image formed on the surface of an image bearing member. In such a developing device, a developer bearing member, on the surface of which a developer layer is formed, and an image bearing member are located in proximity to and opposite to each other, thus forming a development region. Then, an electric field occurring due to a potential difference between the surface potential of the developer bearing member with a development voltage applied thereto and the surface potential of the image bearing member causes toner to move from the developer bearing member to the image bearing member.

In such an image forming apparatus, if a photosensitive drum, serving as an image bearing member, or a developing sleeve, serving as a developer bearing member, is low in roundness or is eccentric, a gap between the photosensitive drum and the developing sleeve (hereinafter referred to as an "SD gap") may periodically vary in association with the rotation thereof. The SD gap may also vary depending on a usage state (initial state or endurance state) of the photosensitive drum or the developing sleeve. Along with this variation, an electric field strength which is formed at the SD gap may vary, so that a periodic density unevenness, in which an image density increases or decreases with a rotation period of the photosensitive drum or the developing sleeve, may occur.

To correct such a density unevenness, there is generally known a technique of modulating, for example, an exposure condition or a developing bias with a rotation period of the photosensitive drum or the developing sleeve, thus correcting a density unevenness. More specifically, before performing image formation, the known technique previously investigates a relationship between a phase (rotational angle) from the home position of the photosensitive drum or the developing sleeve and a periodic image density pattern. After doing that, at the time of image formation, the known technique performs, while detecting the phase (rotational angle) of the photosensitive drum or the developing sleeve, correction corresponding to the detected phase (rotational angle).

At this time, the respective rotation periods of the photosensitive drum and the developing sleeve are not necessarily in synchronization with each other. In a case where the respective rotation periods of the photosensitive drum and the developing sleeve are not in synchronization with each other, periodic image density unevennesses respectively caused by the photosensitive drum and the developing sleeve may interfere with each other, thus generating a beat, and, as a result, an irregularly periodic density variation may occur. In such a case, a detection misalignment of the relationship between a phase (rotational angle) from the home position of the photosensitive drum or the developing sleeve and a periodic image density pattern becomes likely to occur. If a detection misalignment of the phase (rotational angle) occurs, a phase obtained at the time of correction may also become out of alignment, so that the accuracy of density correction may become lower.

Therefore, Japanese Patent Application Laid-Open No. 2004-109483 discusses a technique of, to detect a periodic image density unevenness caused by the photosensitive drum and the developing sleeve, setting the rotation period of the developing sleeve to one integer-th of the rotation period of the photosensitive drum and synchronizing the respective rotation periods of the photosensitive drum and the developing sleeve with each other.

As in an image forming apparatus discussed in Japanese Patent Application Laid-Open No. 2004-109483, synchronizing the respective rotation periods of the photosensitive drum and the developing sleeve with each other prevents or reduces the occurrence of an irregularly periodic density variation and, therefore, enables increasing the detection accuracy and decreasing a detection misalignment of the phase (rotational angle). On the other hand, in a case where the respective rotation periods of the photosensitive drum and the developing sleeve are synchronized with each other not only at the time of detecting a periodic image density unevenness caused by the photosensitive drum and the developing sleeve but also at the time of normal image formation, a density variation at the time of normal image formation occurs with regularity. This increases not only a noticeability at the time of detecting a periodic image density unevenness but also a noticeability at the time of normal image formation, so that a periodic image density unevenness at the time of normal image formation may become easily noticeable.

SUMMARY OF THE DISCLOSURE

Aspects of the present disclosure are generally directed to, while increasing the detection accuracy of a phase (rotational angle) of a photosensitive drum or a developing sleeve in detecting a periodic image density unevenness, making a periodic image density unevenness at the time of normal image formation not easily noticeable.

According to an aspect of the present disclosure, an image forming apparatus includes a rotatable image bearing member configured to allow an electrostatic image to be formed thereon, an image forming unit including an exposure device configured to expose the image bearing member to form an electrostatic image on the image bearing member and a developing device including a development container accommodating a developer and a rotatable developer bearing member configured to bear the developer thereon to develop an electrostatic image formed on the image bearing member, a developing bias application unit configured to apply a developing bias to the developer bearing member, a first phase detection unit configured to detect a phase of the image bearing member, a second phase detection unit configured to detect a phase of the developer bearing member, a controller configured to control the image forming unit in such a way as to form a toner pattern in a case where the controller receives a correction instruction for image density, and an image density detection unit configured to detect an image density of the toner pattern formed by the image forming unit, wherein the controller is able to, in a case where the controller receives the correction instruction, execute a phase detection mode for detecting a phase of the image bearing member by the first phase detection unit and detecting a phase of the developer bearing member by the second phase detection unit and change an image forming condition for the image forming unit during an image formation mode based on respective phases of the image bearing member and the developer bearing member detected in the phase detection mode and an image density of the toner pattern detected by the image density detection unit, and wherein a ratio of a circumferential velocity of the developer bearing member to a circumferential velocity of the image bearing member during the phase detection mode is smaller than a ratio of a circumferential velocity of the developer bearing member to a circumferential velocity of the image bearing member during the image formation mode.

According to another aspect of the present disclosure, an image forming apparatus includes a rotatable image bearing member configured to allow an electrostatic image to be formed thereon, an image forming unit including an exposure device configured to expose the image bearing member to form an electrostatic image on the image bearing member and a developing device including a development container accommodating a developer and a rotatable developer bearing member configured to bear the developer thereon to develop an electrostatic image formed on the image bearing member, a developing bias application unit configured to apply a developing bias to the developer bearing member, a first phase detection unit configured to detect a phase of the image bearing member, a second phase detection unit configured to detect a phase of the developer bearing member, a controller configured to control the image forming unit in such a way as to form a toner pattern in a case where the controller receives a correction instruction for image density, and an image density detection unit configured to detect an image density of the toner pattern formed by the image forming unit, wherein the controller is able to, in a case where the controller receives the correction instruction, execute a phase detection mode for detecting a phase of the image bearing member by the first phase detection unit and detecting a phase of the developer bearing member by the second phase detection unit and change an image forming condition for the image forming unit during an image formation mode based on respective phases of the image bearing member and the developer bearing member detected in the phase detection mode and an image density of the toner pattern detected by the image density detection unit, and wherein a ratio of a circumferential velocity of the developer bearing member to a circumferential velocity of the image bearing member during the phase detection mode is larger than a ratio of a circumferential velocity of the developer bearing member to a circumferential velocity of the image bearing member during the image formation mode.

Further features of the present disclosure will become apparent from the following description of exemplary embodiments with reference to the attached drawings.

DESCRIPTION OF THE EMBODIMENTS

Figure 1:
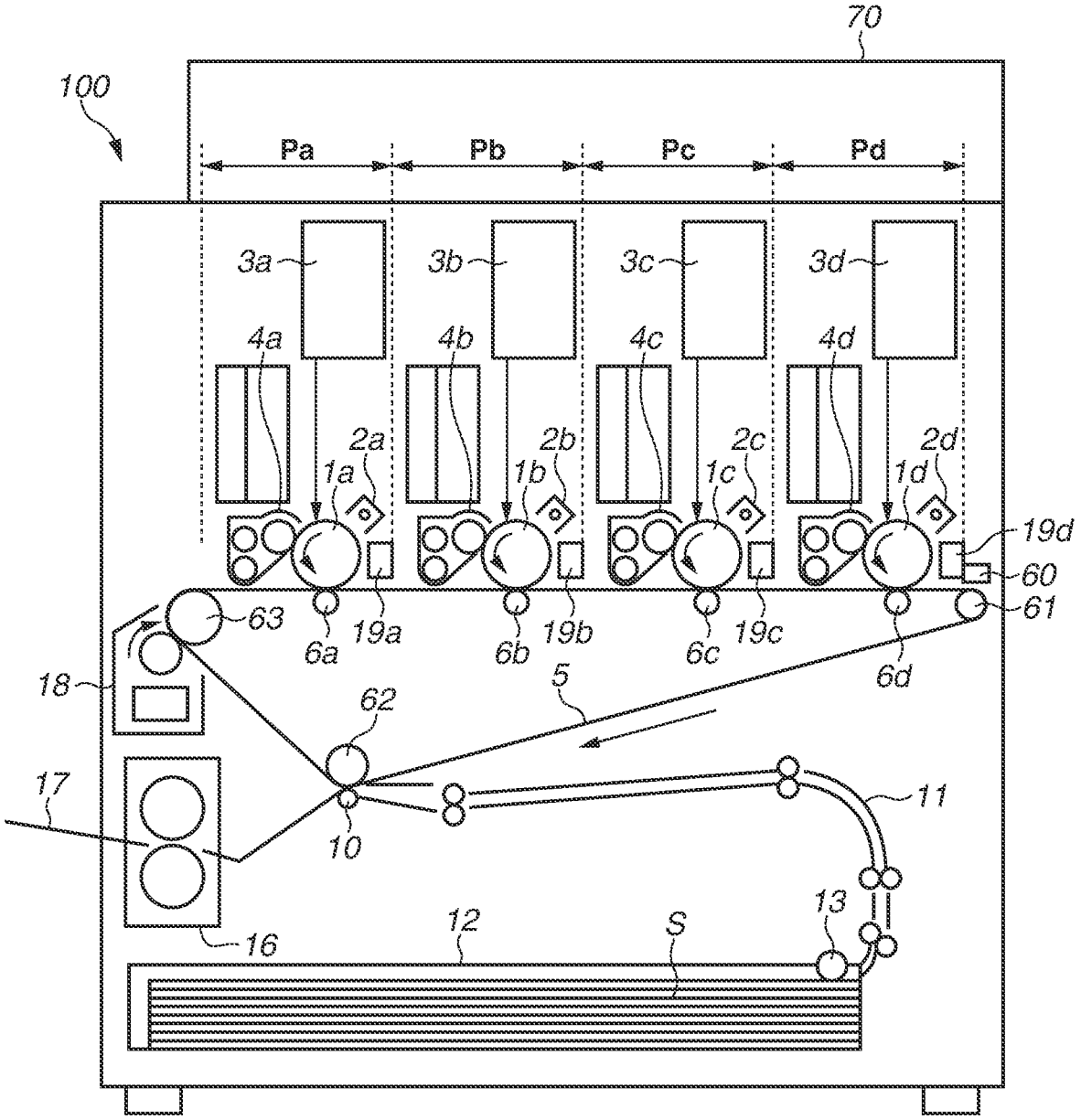
FIG. 1 is an outline configuration sectional view of an image forming apparatus according to a first exemplary embodiment of the present disclosure.

Various exemplary embodiments, features, and aspects of the present disclosure will be described in detail below with reference to the drawings. Furthermore, the following exemplary embodiments should not be construed to limit the present disclosure set forth in the claims, and not all of the combinations of features described in the exemplary embodiments are necessarily essential for solutions in the present disclosure.

<Configuration of Image Forming Apparatus>

First, an outline configuration of an image forming apparatus 100 according to a first exemplary embodiment is described with reference to FIG. 1.

In the first exemplary embodiment, a tandem-type full-color printer is described as an example of the image forming apparatus 100. However, a configuration of the present exemplary embodiment is not limited to a configuration mounted in the tandem-type image forming apparatus 100, but can be a configuration mounted in a different type image forming apparatus, and moreover, the image forming apparatus 100 is not limited to a full-color printer, but can be a monochrome or mono-color printer. Alternatively, a configuration of the present exemplary embodiment can be implemented for various uses in, for example, a printer, any type of printing machine, a copying machine, a facsimile apparatus, and a multifunction peripheral.

The image forming apparatus 100 in the first exemplary embodiment, which is a full-color image forming apparatus 100 of the electrophotographic type, includes four image forming units P (Pa, Pb, Pc, and Pd). Furthermore, the configurations of the respective image forming units P are assumed to be substantially the same except that different developing colors are used. Therefore, in the following description, in a case where no specific distinction is required, suffixes "a", "b", "c", and "d" appended to reference characters "P", "1" to "4", "6", and "19" described below to indicate to which of the image forming units P an element concerned belongs are omitted, and each element is collectively described.

The image forming unit P includes a drum-shaped electrophotographic photosensitive member, i.e., a photosensitive drum 1, which serves as an image bearing member configured to bear a toner image thereon and rotates in the direction of the illustrated arrow (counterclockwise). Then, around the photosensitive drum 1, the image forming unit P includes an image forming element composed of, for example, a charging device 2, a laser beam scanner 3 (exposure device) serving as an exposure unit, a developing device 4, a transfer roller 6, and a cleaning unit 19.

Next, an image forming sequence in a normal mode of the entire image forming apparatus 100 is described. First, the photosensitive drum 1 is electrically charged in a uniform manner by the charging device 2. In the normal mode, the photosensitive drum 1 rotates in a counterclockwise direction indicated by an arrow in FIG. 1. The uniformly charged photosensitive drum 1 is exposed in a scanning manner by the laser beam scanner 3 with laser light modulated by an image signal.

The laser beam scanner 3 has a semiconductor laser built therein, and the semiconductor laser is controlled based on the input image data to emit laser light. For example, the semiconductor laser is controlled in response to a document image information signal (image data) input from a document reading device including a photoelectric conversion element such as a charge-coupled device (CCD) sensor or in response to an image information signal input from an external terminal, thus emitting laser light. This causes the surface potential of the photosensitive drum 1 electrically charged by the charging device 2 to change at image portions, so that an electrostatic latent image is formed on the photosensitive drum 1. In the first exemplary embodiment, an electrostatic latent image forming unit is configured with the charging device 2 and the laser beam scanner 3.

The electrostatic latent image formed on the photosensitive drum 1 in the above-mentioned way is subjected to reversal development with toner by the developing device 4 and is thus converted into a visible image, i.e., a toner image. In the first exemplary embodiment, the developing device 4 uses a two-component developing method, which uses a developer including toner and carrier. Thus, the developing devices 4*a*, 4*b*, 4*c*, and 4*d* store two-component developers including toners of respective colors. Specifically, the developing device 4*a* stores a toner of yellow (Y), the developing device 4*b* stores a toner of magenta (M), the developing device 4*c* stores a toner of cyan (C), and the developing device 4*d* stores a toner of black (K). Accordingly, in response to the above-mentioned process being performed with respect to each of the image forming units Pa, Pb, Pc, and Pd, toner images of four colors, i.e., yellow, magenta, cyan, and black, are respectively formed on the photosensitive drums 1*a*, 1*b*, 1*c*, and 1*d*.

Moreover, at positions below the image forming units Pa, Pb, Pc, and Pd, an intermediate transfer belt 5 serving as an intermediate transfer member is arranged. The intermediate transfer belt 5 is suspended in a tensioned manner by rollers 61, 62, and 63 and is made movable in the direction of the illustrated arrow. Toner images on the photosensitive drums 1 are sequentially transferred to the intermediate transfer belt 5 by the transfer rollers 6 each serving as a primary transfer unit. This causes toner images of four colors, i.e., yellow, magenta, cyan, and black, to be superposed on each other on the intermediate transfer belt 5, so that a full-color image is formed on the intermediate transfer belt 5. Moreover, toner remaining on the photosensitive drum 1 without being transferred to the intermediate transfer belt 5 is recovered ty the cleaning unit 19.

The full-color image formed on the intermediate transfer belt 5 is transferred to a recording material S, such as a sheet (e.g., paper or overhead projector (OHP) sheet), which has been taken out from a feeding cassette 12 and has been conveyed via a feeding roller 13 and a feeding guide 11, by the action of a secondary transfer roller 10. Toner remaining on the surface of the intermediate transfer belt 5 without being transferred to the recording material S is recovered by an intermediate transfer belt cleaning unit 18. On the other hand, the recording material S with a toner image transferred thereto is conveyed to a fixing device 16, is subjected to image fixing thereby, and is then discharged to a discharge tray 17.

Furthermore, the charging method, transfer method, cleaning method, and fixing method are not limited to the above-mentioned methods.

<Configuration of Photosensitive Drum>

While, in the first exemplary embodiment, the photosensitive drum 1, which is a drum-shaped organic photosensitive member normally used, is used as an image bearing member, naturally, an inorganic photosensitive member such as an amorphous silicon photosensitive member can also be used.

Figure 3:
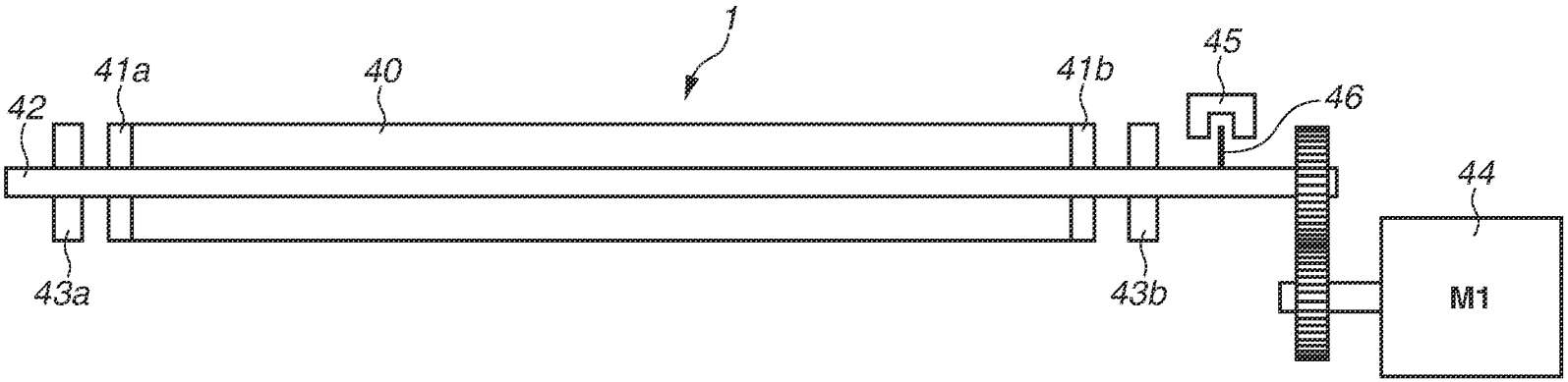
FIG. 3 is an outline configuration sectional view of a photosensitive drum according to the first exemplary embodiment of the present disclosure.

As illustrated in FIG. 3, the photosensitive drum 1 is composed of a cylindrical support medium 40 made from aluminum and supporting members 41*a* and 41*b*. The diameter of the photosensitive drum 1 in the first exemplary embodiment is 30 millimeters (mm). The upper portion (outer circumferential portion) of the support medium 40 has a layer configuration composed of a conductive layer, an undercoat layer, a charge generation layer, a charge transport layer, and a protective layer stacked in this order from below. The supporting members 41*a* and 41*b* are fitted on both ends of the support medium 40. Holes are formed at the respective central portions of the supporting members 41*a* and 41*b*, and a columnar shaft member 42 is integrally fitted into the holes. The both ends of the shaft member 42 are rotatably supported by bearings 43*a* and 43*b*, so that the shaft member 42 is configured to be driven to rotate by a motor 44 via gears.

<Configuration of Developing Device>

Figure 2:
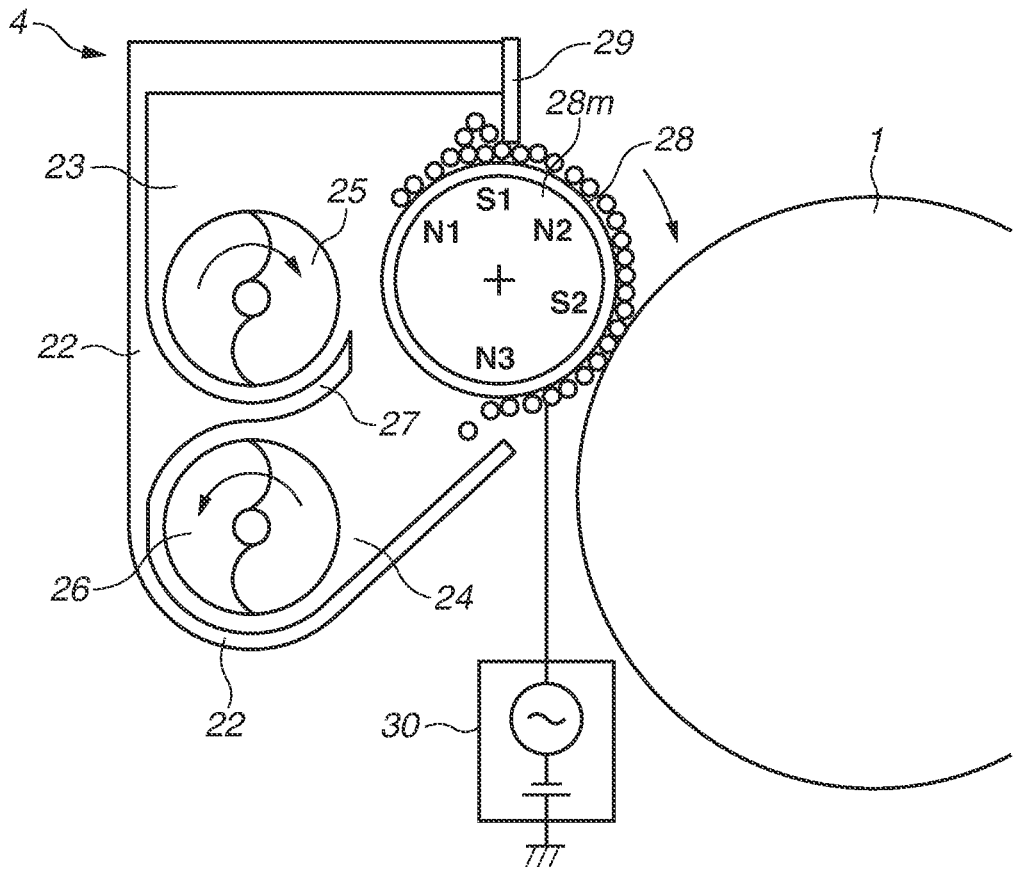
FIG. 2 is an outline configuration sectional view of a developing device according to the first exemplary embodiment of the present disclosure.

Next, the developing device 4 is described with reference to FIG. 2. The developing device 4 includes a developing container 22, which stores a two-component developer including toner and carrier, a developing sleeve 28, which serves a developer bearing member, and a first conveying screw 25 and a second conveying screw 26, which serve as a conveyance member. Moreover, since the developing device 4 in the first exemplary embodiment is of the vertical agitation type, in the inside of the developing container 22, the approximately central portion thereof is vertically partitioned into a developing chamber 23 and an agitating chamber 24, which serve as a storing portion, by a partition wall 27 extending along the axial direction of the developing sleeve 28. The developer is stored in the developing chamber 23 and the agitating chamber 24.

The first conveying screw 25 and the second conveying screw 26 are arranged in the developing chamber 23 and the agitating chamber 24, respectively. The first conveying screw 25 is arranged at a bottom portion of the developing chamber 23, which is on the upper side, almost in parallel with the developing sleeve 28 along the axial direction of the developing sleeve 28. The first conveying screw 25 rotates in the clockwise direction as viewed in FIG. 2 and conveys, while agitating, the developer present in the developing chamber 23 in a direction (first direction) along the rotational axis direction of the first conveying screw 25. Moreover, the second conveying screw 26 is arranged at a bottom portion of the agitating chamber 24, which is on the lower side, almost in parallel with the first conveying screw 25 and rotates in the counterclockwise direction as viewed in FIG. 2, which is opposite to the direction of the first conveying screw 25. Then, the second conveying screw 26 conveys, while agitating, the developer present in the agitating chamber 24 in a direction (second direction) opposite to the direction of the first conveying screw 25 along the rotational axis direction of the second conveying screw 26.

In this way, conveying the developer by the rotations of the first conveying screw 25 and the second conveying screw 26 causes the developer to circulate between the developing chamber 23 and the agitating chamber 24 via opening portions of the both ends of the partition wall 27. Furthermore, while, in the first exemplary embodiment, a case where the first exemplary embodiment is applied to a developing device 4 in which the developing chamber 23 and the agitating chamber 24 are vertically arranged is described, the first exemplary embodiment is not limited to this. For example, the first exemplary embodiment can also be applied to a conventionally used developing device in which the developing chamber 23 and the agitating chamber 24 are horizontally arranged or a developing device with another type of configuration.

Here, a two-component developer including toner and carrier, which is used in the first exemplary embodiment, is described. In toner, an external additive such as a colloidal silica fine powder is externally added to colored resin particles including binder resin, colorant, and other additives as needed. It is favorable that toner for use in the first exemplary embodiment is polyester system resin of the negatively charged polarity and the volume mean grain diameter thereof is 3 micrometers (μm) or more and 8 μm or less.

Moreover, as carrier, for example, a metal such as superficially oxidized or unoxidized iron, nickel, cobalt, manganese, chrome, or rare-earth metal, an alloy of those metals, or oxide ferrite can be adaptively used, and the method of manufacturing these magnetic particles is not specifically limited. In carrier, the volume mean grain diameter thereof is 20 μm to 50 μm, favorably, 25 μm to 45 μm, and the resistivity thereof is $10^7$ ohm centimeters (Ω·cm) or more, favorably, $10^8$ Ω·cm more. In the first exemplary embodiment, carrier having a resistivity of $10^8$ Ω·cm is used.

There is an opening portion at a position of the developing container 22 equivalent to a developing position which faces the photosensitive drum 1, and the developing sleeve 28 is rotatably arranged at the opening portion in such a manner that a part of the developing sleeve 28 is exposed in the direction of the photosensitive drum 1. The developing sleeve 28 bears and conveys the developer stored in the developing container 22, thus supplying the developer to the developing position of the photosensitive drum 1.

In the first exemplary embodiment, a support medium 50 (see FIG. 4) of the developing sleeve 28 is in the shape of a cylinder having a diameter of 20 mm and is configured with a non-magnetic material such as aluminum or non-magnetic stainless steel and made from aluminum in the first exemplary embodiment. Inside the developing sleeve 28, a magnet roller 28*m* which has a plurality of magnetic poles arranged at the surface thereof and is supported by the developing container 22 in a non-rotatable manner.

In the first exemplary embodiment, the magnet roller 28*m* has a developing pole S2, a restriction pole S1, a conveyance pole N2, a scraping pole N3, and a drawing pole N1. The developing pole S2 is arranged opposite to the photosensitive drum 1. The restriction pole S1 is arranged opposite to a restriction member 29. The drawing pole N1 is arranged adjacent to the restriction pole S1 on the upstream side in the rotational direction of the developing sleeve 28 to draw the developer from the developing chamber 23. The scraping pole N3 is arranged adjacent to the drawing pole N1 on the upstream side in the rotational direction of the developing sleeve 28. A repulsive magnetic field is formed between the scraping pole N3 and the drawing pole N1, so that scraping of the developer is performed between the scraping pole N3 and the drawing pole N1. The conveyance pole N2 is arranged between the restriction pole S1 and the developing pole S2. The magnitude of magnetic flux density of each magnetic pole is set to 40 millitesla (mT) to 130 mT.

Figure 4:
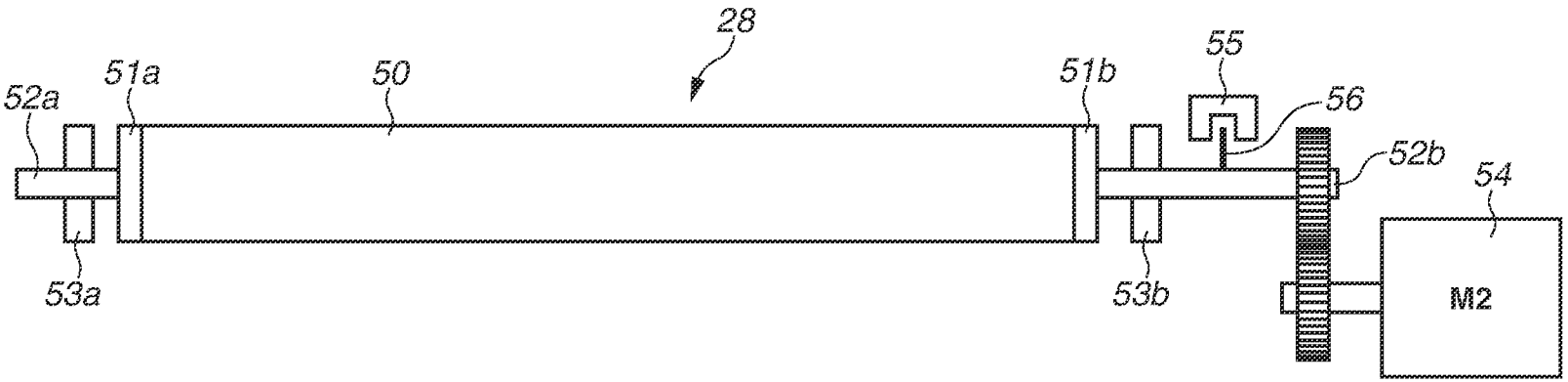
FIG. 4 is an outline configuration sectional view of a developing sleeve according to the first exemplary embodiment of the present disclosure.

As illustrated in FIG. 4, flanges 51*a* and 51*b* are fitted on the both end portions of the support medium 50 of the developing sleeve 28. Then, the flanges 51*a* and 51*b* have cylindrical projection portions 52*a* and 52*b*, respectively, which are rotatably supported by bearings 53*a* and 53*b*, respectively, so that the developing sleeve 28 is configured to be driven to rotate by a motor 54 via gears.

The restriction member 29 is configured with a non-magnetic member formed from, for example, a plate-like stainless steel extending along the rotational axis of the developing sleeve 28 and is arranged on the more upstream side in the rotational direction of the developing sleeve 28 than the photosensitive drum 1. Then, both toner and carrier included in the developer pass between the fore-end portion of the restriction member 29 and the developing sleeve 28, thus being conveyed to the developing position.

Furthermore, adjusting a gap between the restriction member 29 and the surface of the developing sleeve 28 enables restricting the amount of brush cutting of a developer magnetic brush borne on the developing sleeve 28, thus adjusting the amount of developer to be conveyed to the developing position. In the first exemplary embodiment, the restriction member 29 is used to restrict a developer coat amount per unit area on the developing sleeve 28 to, for example, 30 milligrams per square centimeter ($mg/cm^2$). Moreover, the gap between the restriction member 29 and the developing sleeve 28 is set to 200 micrometers (μm) to 1,000 μm, favorably, 300 μm to 700 μm. In the first exemplary embodiment, the gap is set to 400 μm. Furthermore, while, in the first exemplary embodiment, a non-magnetic member is used as the restriction member 29, a magnetic member can be used.

Here, the distance in nearest region between the developing sleeve 28 and the photosensitive drum 1 (hereinafter referred to as an "SD gap") is assumed to be, for example, about 250 μm. This causes a magnetic brush of the developer borne on the developing sleeve 28 and conveyed to the developing position in a state in which the length of the magnetic brush is restricted by the restriction member 29 to come into contact with the photosensitive drum 1, thus performing development of an electrostatic latent image formed on the photosensitive drum 1.

At this time, in the development region facing the photosensitive drum 1, the developing sleeve 28 moves in a forward direction relative to the movement direction of the photosensitive drum 1, and, in the normal mode (at the time of normal image formation), moves in such a manner that the circumferential velocity ratio thereof to the photosensitive drum 1 is, for example, 1.7 times. In the first exemplary embodiment, in the normal mode, the photosensitive drum 1 rotates at a circumferential velocity of 348 millimeters per second (mm/sec). The developing sleeve 28 rotates at a circumferential velocity of 591.6 mm/sec.

Furthermore, while, in the first exemplary embodiment, a configuration in which, in the development region, the developing sleeve 28 and the photosensitive drum 1 rotate in the forward direction (same direction) has been described, the first exemplary embodiment can be applied to a configuration in which the developing sleeve 28 and the photosensitive drum 1 rotate in counter directions (opposite directions).

To the developing sleeve 28, a high-voltage power source 30 (a developing bias application unit), which applies a direct-current voltage and an alternating-current voltage as developing bias voltages to the developing sleeve 28, is connected. On the surface of the developing sleeve 28, a magnetic brush is formed by toner charged to the negative polarity being electrostatically restrained to the surface of carrier charged to the positive polarity. Then, an electric potential difference is provided between a developing bias voltage applied to the developing sleeve 28 and an electrostatic latent image formed on the photosensitive drum 1, so that, due to an electric field strength formed in the development region, toner is caused to fly to the photosensitive drum 1, thus making the latent image into a visible image.

In the above-described configuration, if the photosensitive drum 1 or the developing sleeve 28 is low in roundness or is eccentric, a gap between the photosensitive drum 1 and the developing sleeve 28 (SD gap) may periodically vary in association with the rotation thereof. Moreover, the SD gap may also vary depending on a usage state (initial state or endurance state) of the photosensitive drum 1 or the developing sleeve 28. Along with this variation, an electric field strength which is formed at the SD gap may vary, so that a periodic density unevenness, in which an image density increases or decreases with a rotation period of the photosensitive drum 1 or the developing sleeve 28, may occur.

To correct such a density unevenness, there is generally known a technique of modulating, for example, an exposure condition or a developing bias with a rotation period of the photosensitive drum 1 or the developing sleeve 28, thus correcting a density unevenness. More specifically, before performing image formation, the known technique previously investigates a relationship between a phase (rotational angle) from the home position of the photosensitive drum 1 or the developing sleeve 28 and a periodic image density pattern. After doing that, at the time of image formation, the known technique performs, while detecting the phase (rotational angle) of the photosensitive drum 1 or the developing sleeve 28, correction corresponding to the detected phase (rotational angle). The first exemplary embodiment also employs such a density unevenness correction technique, as described below in a sequential order.

The first exemplary embodiment is configured to make a periodic image density unevenness occurring at the time of normal image formation unlikely to be noticeable, while increasing the detection accuracy of the phase (rotational angle) of the photosensitive drum 1 or the developing sleeve 28 at the time of detecting the periodic image density unevenness. The details thereof are described below.

<Image Density Detection Unit>

The image forming apparatus 100 includes an optical sensor unit 60 as an image density detection unit which detects image densities of Y, M, C, and K toner images formed by the respective image forming units Pa, Pb, Pc, and Pd. The optical sensor unit 60 faces a position at which the intermediate transfer belt 5 is suspended and hung by the roller 61, via a predetermined gap from the outer surface side of the intermediate transfer belt 5.

The optical sensor unit 60 includes, for example, a light emitting element and a regular reflection light receiving element or an irregular reflection light receiving element. Light emitted from the light emitting element of the optical sensor unit 60 is reflected by the surface of a toner image formed on the intermediate transfer belt 5 and is then received by the regular reflection light receiving element or the irregular reflection light receiving element. Then, the optical sensor unit 60 outputs a voltage corresponding to the amount of received regular reflection light or irregular reflection light, so that a controller of the image forming apparatus 100 detects the image density of a toner image based on the voltage value.

Furthermore, image detection of a toner image is not limited to a configuration of performing image detection on the intermediate transfer belt 5 as in the first exemplary embodiment. For example, image detection can be performed on the photosensitive drum 1 or can be performed on a sheet of recording paper. Besides, in the case of an image forming apparatus including a secondary transfer belt, image detection can be performed on the secondary transfer belt. Moreover, with regard to an image density detection unit, for example, a colorimeter can be employed or an inline-type image sensor provided near a paper discharge portion can be employed.

<Phase (Rotational Angle) Detection Unit>

As illustrated in FIG. 3, the photosensitive drum 1 is provided with a photosensitive member photo-interrupter 45 serving as a photosensitive member rotational phase detection unit which detects the phase (rotational angle) of the photosensitive drum 1. The photosensitive drum 1 includes a light blocking member 46 which is integrated with the shaft member 42, which rotationally moves in association with the rotation of the photosensitive drum 1. The light blocking member 46 is detected by the photosensitive member photo-interrupter 45 when the photosensitive drum 1 has occupied a predetermined rotational position according to the rotation of the photosensitive drum 1. This enables the photosensitive member photo-interrupter 45 to detect the rotational position of the photosensitive drum 1.

As with the photosensitive drum 1, the developing sleeve 28 also includes a developing photo-interrupter 55 and a light blocking member 56 serving as a developing rotational phase detection unit which detects the phase (rotational angle) of the developing sleeve 28. Then, the developing photo-interrupter 55 detects the phase (rotational angle) of the developing sleeve 28 as in the case of the photosensitive drum 1.

As each rotational phase detection unit, a reflecting mirror and a photosensor can be used. In this case, for example, the reflecting mirror is provided at a partial region of a gear used to transmit drive force of the motor 44 or 54 to the photosensitive drum 1 or the developing sleeve 28, and the photosensor is used to detect that the gear has reached a predetermined phase (rotational angle).

In this way, as long as the rotation of the photosensitive drum 1 or the developing sleeve 28 is indirectly predictable, the photosensitive drum 1 or the developing sleeve 28 does not need to be directly detected. Besides, the rotation member detection unit is not limited to such configurations as long as it is a unit capable of detecting the rotational position, such as a rotary encoder.

<Phase Detection Method>

It is favorable to perform correction to a density unevenness in synchronization with a shake of the photosensitive drum 1 or the developing sleeve 28. Therefore, simultaneously acquiring a phase (rotational angle) detected by the rotational phase detection unit and a density unevenness caused by eccentricity detected by the image density detection unit prior to density unevenness correction enables correcting a density unevenness in synchronization with the rotational position of the photosensitive drum 1 or the developing sleeve 28.

Figure 5:
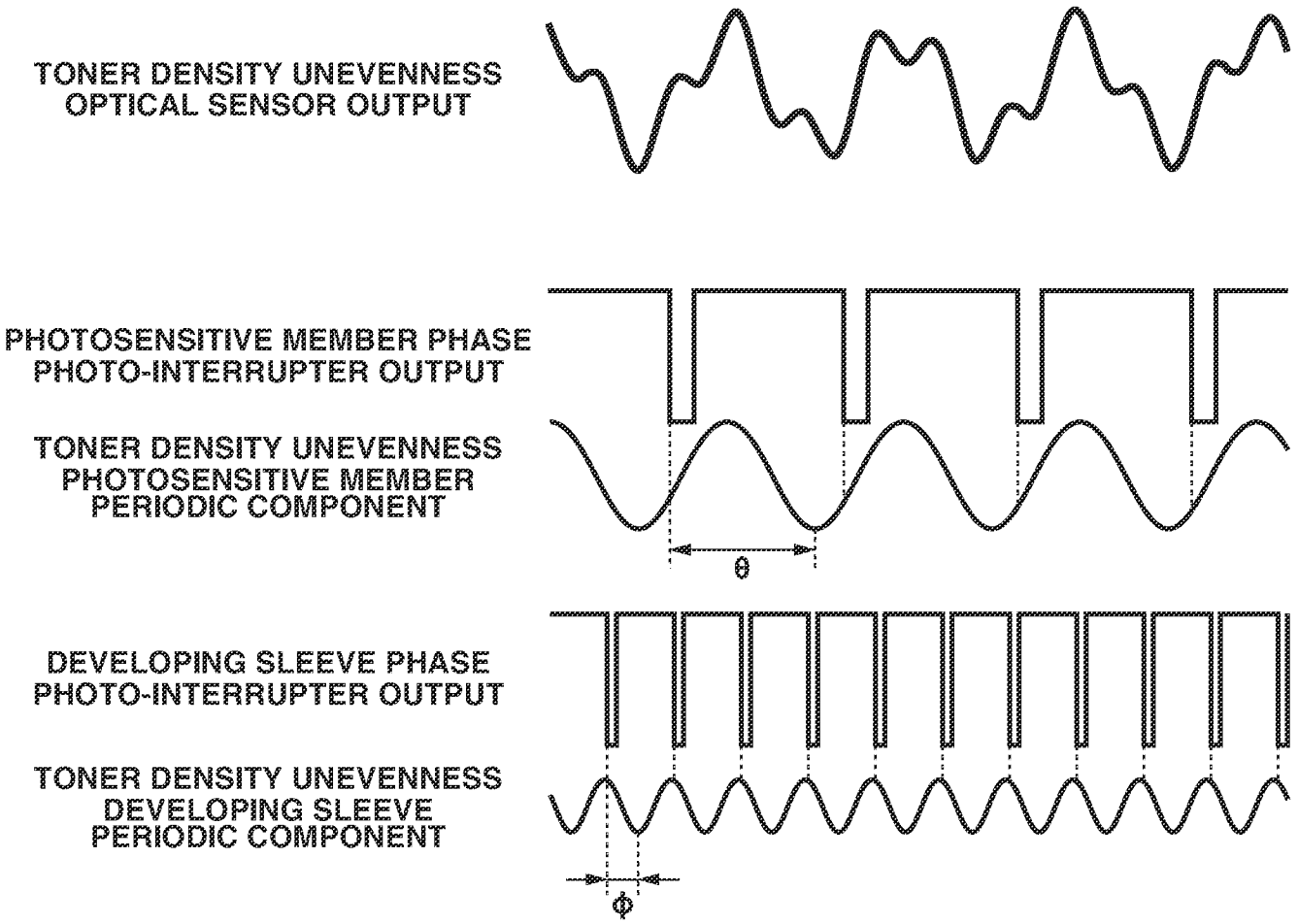
FIG. 5 is a schematic diagram illustrating, side by side, a detection signal obtained by an image density detection unit, an output signal from a rotational position detection unit, and density variations occurring at the photosensitive drum and the developing sleeve obtained by performing waveform separation of the detection signal obtained by the image density detection unit.

FIG. 5 illustrates examples of a density unevenness which is detected by the optical sensor unit 60, a photosensitive member rotational position signal which is detected by the photosensitive member photo-interrupter 45, and a developing rotational position signal which is detected by the developing photo-interrupter 55 in a case where the image of a test patch (toner pattern) for phase detection has been formed. The density unevenness which is detected by the optical sensor unit 60 includes a density unevenness caused by both the photosensitive drum 1 and the developing sleeve 28. Since rotation periods of the photosensitive drum 1 and the developing sleeve 28 are previously known, in principle, a density unevenness corresponding to the rotation periods of the photosensitive drum 1 and the developing sleeve 28 is able to be obtained by performing waveform separation.

FIG. 5 also concurrently illustrates a periodic component of the photosensitive drum 1 and a periodic component of the developing sleeve 28 included in the density unevenness, which have been obtained by performing waveform separation. A relationship between a density unevenness caused by the photosensitive drum 1 and the phase of the photosensitive drum 1 is obtained by comparing a photosensitive member rotational position signal of the photosensitive drum 1 detected by the photosensitive member photo-interrupter 45 with a periodic component of the photosensitive drum 1 obtained by performing waveform separation of the density unevenness detected by the optical sensor unit 60. Specifically, in the case of setting a phase at which the light blocking member 46 passes over the photosensitive member photo-interrupter 45 (timing at which a detection signal from the photosensitive member photo-interrupter 45 disappears) as a home position, the periodic component of the photosensitive drum 1 has a density variation in which the periodic component becomes a minimum value at a position deviating from the home position by a rotational angle $\theta$. With regard to the developing sleeve 28, similarly, a relationship between a density unevenness caused by the developing sleeve 28 and the phase of the developing sleeve 28 is able to be obtained. Specifically, the periodic component of the developing sleeve 28 has a density variation in which the periodic component becomes a minimum value at a position deviating from the home position by a rotational angle $\varphi$.

At the time of density unevenness correction, control which cancels out a density variation in synchronization with a periodic variation accompanied by the rotation of the photosensitive drum 1 or the developing sleeve 28 is performed based on the above-mentioned relationships. The details of density unevenness correction are described below. Furthermore, the above-mentioned series of operations related to density unevenness correction is performed by a central processing unit (CPU) and a controller (both not illustrated).

Thus, the controller corrects a density unevenness by correcting an image forming condition at the time of normal image formation in such a manner a periodic density variation of an image which is formed by an image forming unit is prevented or reduced, based on a detection result obtained by an image density detection unit and a detection result obtained by a phase detection unit. More specifically, the controller calculates information about a periodic image density unevenness which occurs with the rotation period of the photosensitive drum 1 or the rotation period of the developing sleeve 28, based on a detection result obtained by the image density detection unit. Then, the controller corrects an image forming condition based on the calculated information about a periodic image density unevenness and position information about the photosensitive drum 1 and the developing sleeve 28. Here, the image forming condition to be corrected is, for example, an exposure condition on which the surface of the photosensitive drum 1 is exposed by the laser beam scanner 3 or/and a condition for a developing bias which is applied to the developing sleeve 28 by the high-voltage power source 30.

<Density Unevenness Correction Value>

Next, a method of obtaining a density unevenness correction value is described. First, the controller outputs a chart for density unevenness correction. The controller causes a sheet of paper with an output image formed thereon to be set on a scanner 70, and obtains, via the CPU, a density correction value based on the density distribution of an output image read by the scanner 70. The density distribution of an output image obtained by the scanner 70 reading the sheet of paper with an output image formed thereon is transferred to the CPU.

Figure 6:
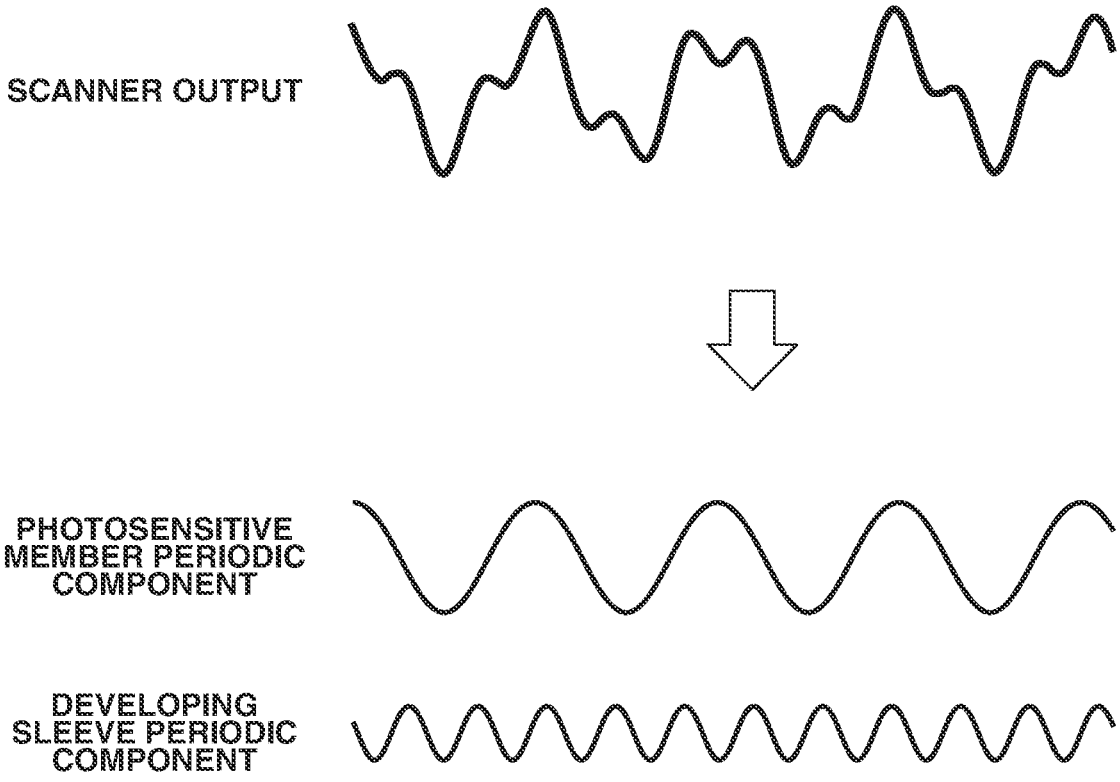
FIG. 6 is a schematic diagram illustrating, side by side, a detection signal obtained by the image density detection unit and density variations occurring at the photosensitive drum and the developing sleeve obtained by performing waveform separation of the detection signal.

The CPU separates density distribution data extending along the rotational direction in each position along the rotational axis direction of the photosensitive drum 1 into waveforms such as those illustrated in FIG. 6, based on data having a density distribution such as that illustrated in FIG. 6. After performing waveform separation, the CPU obtains density variations corresponding to the respective rotation periods of, for example, the photosensitive drum 1 and the developing sleeve 28. Then, the CPU obtains values of the density variations corresponding to the respective rotation periods of the photosensitive drum 1 and the developing sleeve 28 and thus obtains a density correction value.

Figure 7A:
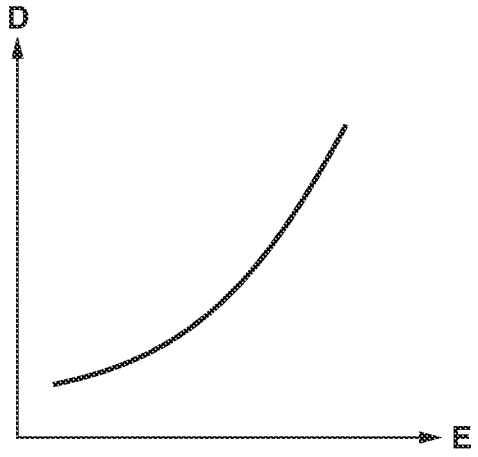
FIGS. 7A, 7B, and 7C are graphs illustrating image characteristics of the image forming apparatus.

The density correction value is calculated based on an exposure amount (E)-density (D) characteristic which is previously measured in the design stage of the image forming apparatus 100, as illustrated in FIG. 7A.

In the case of eventually feeding back the exposure amount (E)-density (D) characteristic to the exposure amount for use in the laser beam scanner 3 as a characteristic to be referred to in determining a density correction value, a density unevenness is reduced even by only performing correction using a relationship in the exposure amount (E)-density (D) characteristic illustrated in FIG. 7A. On the other hand, to perform higher-accuracy correction, it is necessary to take into account what a sub-system which causes a density unevenness is, i.e., which of the photosensitive drum 1 and the developing sleeve 28 the sub-system is.

Figure 7B:
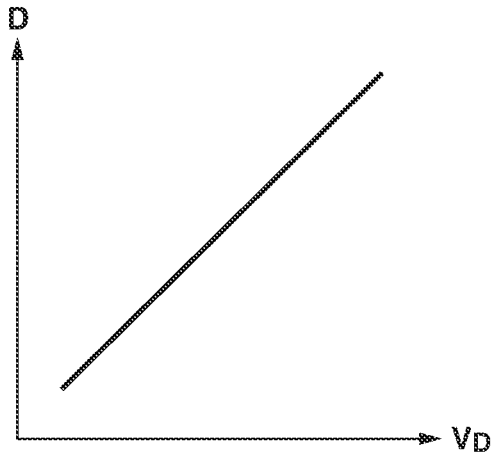

For example, it is also possible to feed back a density unevenness caused by the developing sleeve 28 to a developing bias. The density correction value at this time is calculated based on a developing potential ($V_D$)-density (D) characteristic illustrated in FIG. 7B. In the case of feeding back the density unevenness to a developing bias, it is possible to prevent or reduce a density unevenness even by performing correction based on the above-mentioned developing potential ($V_D$)-density (D) characteristic with the rotation period of the developing sleeve 28. Similarly, even in the case of feeding back a density unevenness caused by the photosensitive drum 1 to the charging device 2, it is possible to prevent or reduce a density unevenness.

Figure 7C:
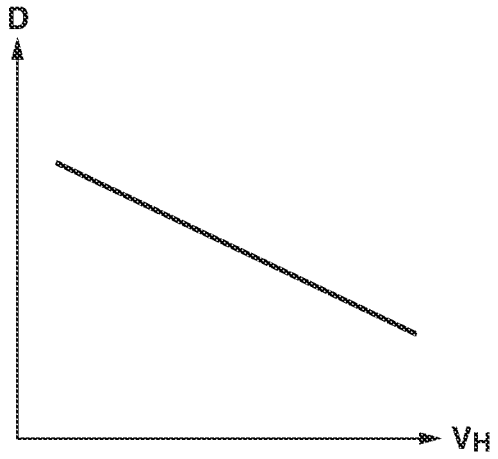

In this case, the CPU performs correction based on a charging potential ($V_H$)-density (D) characteristic illustrated in FIG. 7C. Furthermore, these feedback destinations can be used in combination, and using these feedback destinations in combination enables performing correction with a higher degree of accuracy.

<Density Unevenness Correction Procedure>

Figure 8:
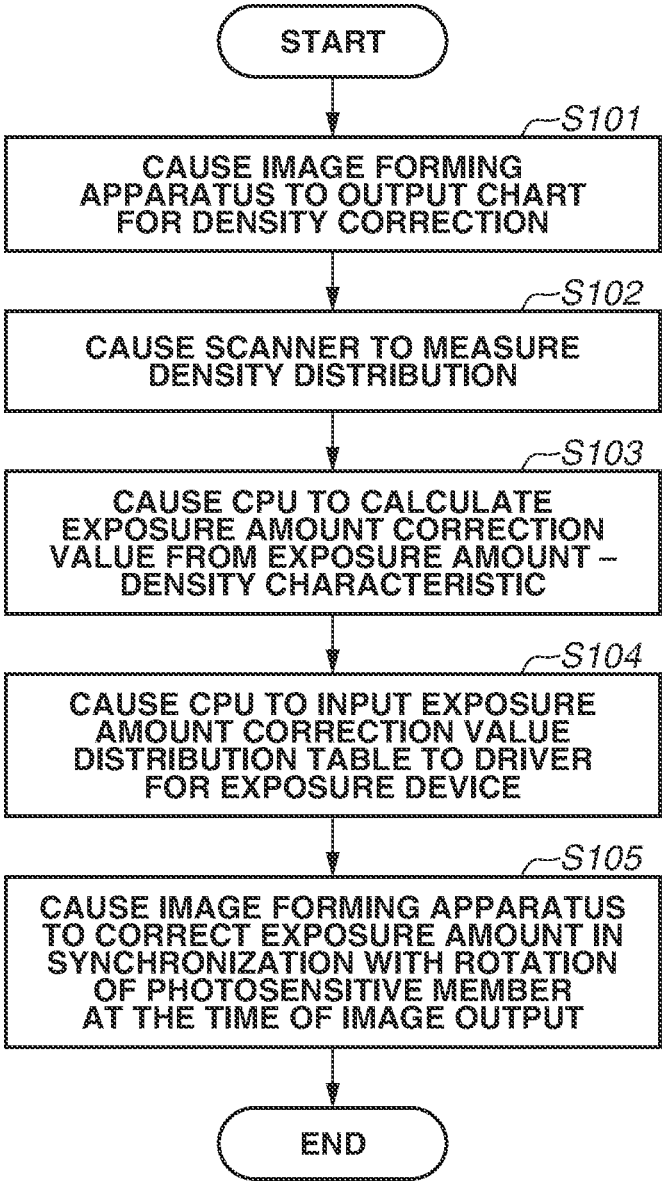
FIG. 8 is a flowchart illustrating a correction operation for image density.

FIG. 8 is a flowchart illustrating a control example of a correction operation for image density according to the first exemplary embodiment. The control operation illustrated in FIG. 8 is performed by the controller reading out a program stored in a read-only memory (ROM) (storage unit) included in the image forming apparatus 100 and controlling various devices. Moreover, in the control operation illustrated in FIG. 8, the flow is started by the controller receiving a starting instruction for correction operation for image density and transitioning from a normal mode to a phase detection mode.

First, in step S101, the controller causes the image forming apparatus 100 to output a chart for density correction.

Next, in step S102, the controller causes the scanner 70 to measure the density distribution of an image on the chart for density correction, and, in step S103, the controller causes the CPU to obtain by calculation a correction value for exposure amount based on an exposure amount—density characteristic. Then, in step S104, the controller causes the CPU to input a table of the obtained exposure amount correction value distribution to a driver for the laser beam scanner 3. Then, in step S105, the controller causes the image forming apparatus 100 to correct an exposure amount based on the exposure amount correction value distribution table in synchronization with the rotation of the photosensitive drum 1 at the time of image output.

The exposure amount correction value obtained in step S103 is read into the driver for the laser beam scanner 3, which is provided in the controller of the image forming apparatus 100, so that the exposure amount is repetitively corrected in synchronization with the rotation period of the photosensitive drum 1. While, here, an example in which, to prevent or reduce a density unevenness, feedback is performed to an exposure amount has also been described, feedback to a developing bias potential or a charging potential can be performed in a manner similar to that for the exposure amount.

Moreover, while, in the above-described example, to measure the density distribution of an image on a chart for density correction, a method of reading a sheet with an output image formed thereon with the scanner 70 is employed, the sheet can be read by an in-line type image sensor provided near a sheet discharge portion of the image forming apparatus 100. Moreover, a detection sensor which reads a toner image on the photosensitive drum 1 or a detection sensor which detects a toner image on the intermediate transfer belt 5 can be used.

In the density unevenness correction control according to the first exemplary embodiment, first, the controller performs phase detection on a phase detection condition different from a normal image forming condition. Then, the controller determines a density unevenness correction amount on the normal image forming condition, and, while detecting a phase (rotational angle) of the photosensitive drum 1 or the developing sleeve 28 based on the obtained phase information and the determined density unevenness correction amount, performs control to perform correction corresponding to the detected phase (rotational angle).

Figure 9:
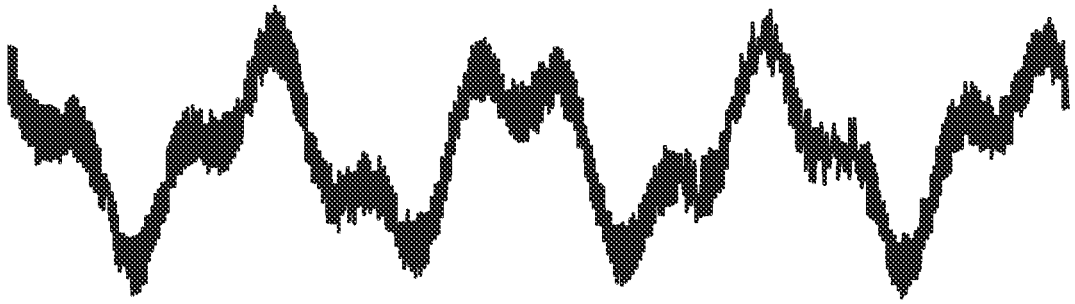
FIG. 9 is a schematic diagram illustrating a detection signal obtained by the image density detection unit.

In a case where density correction has been performed by the above-described method, according to the review by the inventors, there was a case where the effect of density correction was not able to be attained more than expected. Considering the cause thereof, it was found that a detection misalignment occurring at the time of phase detection was one of causes. While FIG. 5 described above illustrates a density unevenness which is detected by the optical sensor unit 60 with respect to a test patch for phase detection, actually, noises are usually superimposed on the detected density unevenness as illustrated in FIG. 9. This is due to causes such as toner not being uniformly applied or other disturbance factors.

If a detection signal is buried in noises in this way, this becomes a factor for an error occurring at the time of performing waveform separation to divide the detection signal into a periodic component of the photosensitive drum 1 and a periodic component of the developing sleeve 28. As a result, a relationship between the variation and phase (rotational angle) of the photosensitive drum 1 or the developing sleeve 28 may be detected in a misaligned state. Therefore, at the time of subsequent correction, correction may be performed in a state in which the phase is out of alignment with respect to the actual variation of the photosensitive drum 1 or the developing sleeve 28.

Figure 10:
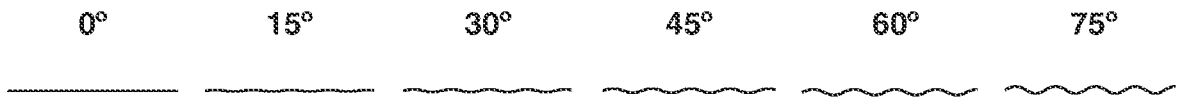
FIG. 10 is a schematic diagram illustrating an influence on a correction result by a phase deviation occurring at the time of image density correction.

FIG. 10 illustrates density variations obtained after correction in a case where correction is performed with the phase of the photosensitive drum 1 intentionally made out of alignment, in increments of 15° from 0° to 75°. While, in a case where amendment has been performed with the degree of misalignment being 0°, i.e., with the variation and the phase being perfectly synchronized with each other, the density variation is completely amended, it can be seen that, as the degree of misalignment becomes larger, the density variation becomes likely to remain even after correction. For this reason, it can be seen that it is important to reduce a detection misalignment occurring at the time of phase detection.

In a case where, as illustrated in FIG. 9, the respective period unevennesses of the photosensitive drum 1 and the developing sleeve 28 have interfered with each other and, thus, an irregular density unevenness has occurred, since the density unevenness is irregular, it is difficult to obtain a number-of-samples increasing effect even if the detection time is made longer, so that it is difficult to reduce a detection misalignment.

Therefore, the first exemplary embodiment is configured to, at the time of phase detection (at the time of a phase detection mode), make the rotational speed of the developing sleeve 28 higher than that at the time of normal image formation (at the time of a normal mode) in such a manner that the ratio of the rotation period of the photosensitive drum 1 to the rotation period of the developing sleeve 28 is set to a relationship of an integral multiple or one integer-th.

Specifically, while the circumferential velocity of the developing sleeve 28 at the time of normal image formation is 591.6 millimeters per second (mm/s), the circumferential velocity of the developing sleeve 28 at the time of phase detection is set to 696 mm/s. Since the diameter of the developing sleeve 28 in the first exemplary embodiment is 20 mm, the time required for one revolution of the developing sleeve 28 is $20\times\pi/696=0.09$ seconds (s).

Figure 11:
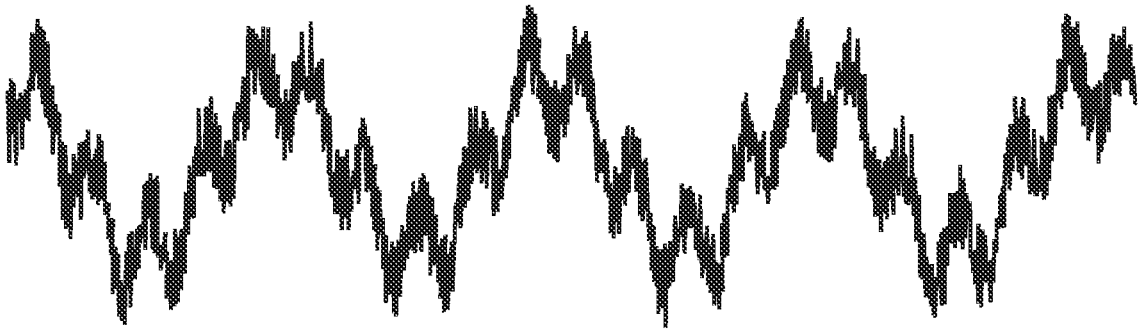
FIG. 11 is a schematic diagram illustrating a detection signal obtained by an image density detection unit of an image forming apparatus according to the first exemplary embodiment of the present disclosure.

On the other hand, since the diameter of the photosensitive drum 1 is 30 mm and the circumferential velocity thereof is 348 mm/s, the time required for one revolution of the photosensitive drum 1 is $30\times7\pi/348=0.27$ s. Accordingly, it can be seen that, at the time of phase detection, there is a relationship in which the developing sleeve 28 makes three revolutions during a period when the photosensitive drum 1 makes one revolution. FIG. 11 illustrates a detection result for a density unevenness occurring by the respective period unevennesses of the photosensitive drum 1 and the developing sleeve 28 interfering with each other at that time. As is understandable from FIG. 11, in a case where the ratio of the rotation period of the photosensitive drum 1 to the rotation period of the developing sleeve 28 has been set to a relationship of an integral multiple or one integer-th, the density unevenness occurring by interference becomes regular. Therefore, it is easy to obtain a number-of-samples increasing effect, so that it becomes possible to prevent or reduce a phase detection misalignment.

While setting the ratio of the rotation period of the photosensitive drum 1 to the rotation period of the developing sleeve 28 to a relationship of an integral multiple or one integer-th enables making the density variation regular and increasing the phase detection accuracy, at the time of normal image formation, as the regularity increases, the noticeability may also increase. Therefore, only at the time of phase detection, the ratio of the rotation period of the photosensitive drum 1 to the rotation period of the developing sleeve 28 is set to a relationship of an integral multiple or one integer-th. On the other hand, in the case of the other normal mode, the ratio of the rotation period of the photosensitive drum 1 to the rotation period of the developing sleeve 28 is prevented from being set to a relationship of an integral multiple or one integer-th.

Figure 12:
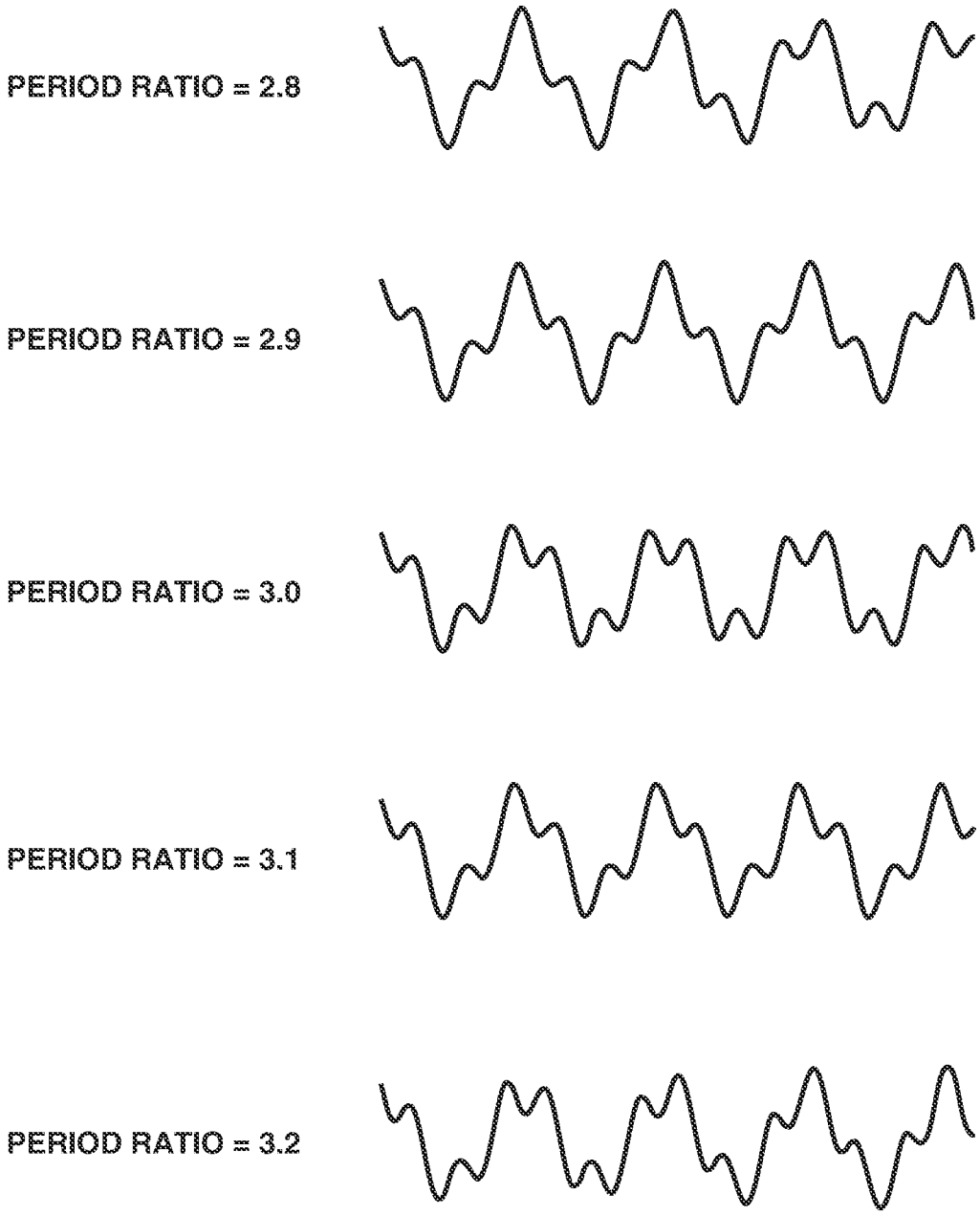
FIG. 12 is a schematic diagram illustrating detection signals obtained by the image density detection unit in the case of varying a ratio between a rotation period of the photosensitive drum and a rotation period of the developing sleeve.

Furthermore, the advantageous effect of the first exemplary embodiment can be obtained even if an integral multiple or one integer-th is not perfect but approximate. FIG. 12 illustrates examples of detected waveforms obtained in cases where the ratio of the rotation period of the photosensitive drum 1 to the rotation period of the developing sleeve 28 is 2.8, 2.9, 3.0, 3.1, and 3.2. In a case where the ratio of the rotation period of the photosensitive drum 1 to the rotation period of the developing sleeve 28 is 3.0 (an integer multiple), the density variation is regular. In a case where the ratio is 2.9 or 3.1, the regularity is also relatively maintained. On the other hand, in a case where the ratio is 2.8 or 3.2, it can be seen that an irregular waveform is beginning to appear. Accordingly, the ratio falls within a range of an integer±0.1, the advantageous effect of the present exemplary embodiment can be almost obtained. Therefore, in the first exemplary embodiment, as long as the ratio falls within a range of an integer±0.1, the ratio is assumed to be approximately an integral number or approximately one integer-th.

In the first exemplary embodiment, only the circumferential velocity of the developing sleeve 28 is changed between at the time of the normal mode and at the time of phase detection, and the circumferential velocity of the photosensitive drum 1 is maintained the same. While, even if the circumferential velocity of the photosensitive drum 1 is changed, the advantageous effect of the first exemplary embodiment is able to be obtained, setting the same circumferential velocity between at the normal mode and at the time of phase detection enables performing phase detection on the same condition as that in the normal mode and, therefore, enables preventing or reducing an unnecessary error from occurring in performing phase detection of the photosensitive drum 1. If there is a concern, phase detection of the developing sleeve 28 can be performed separately from phase detection of the photosensitive drum 1 and, at that time, the circumferential velocity of the developing sleeve 28 can be set the same between at the time of the normal mode and at the time of phase detection.

In the first exemplary embodiment, at the time of phase detection, the rotational speed of the developing sleeve 28 is made higher than that at the time of the normal mode, and the ratio of the rotation period of the photosensitive drum 1 to the rotation period of the developing sleeve 28 is set to a relationship of an integral multiple or one integer-th. On the other hand, even if, at the time of phase detection, the rotational speed of the developing sleeve 28 is made lower than that at the time of the normal mode and the ratio of the rotation period of the photosensitive drum 1 to the rotation period of the developing sleeve 28 is set to a relationship of an integral multiple or one integer-th, a similar advantageous effect is able to be obtained. For example, assuming that the circumferential velocity of the developing sleeve 28 at the time of phase detection is 465.2 mm/s, the time required for the developing sleeve 28 with a diameter of 20 mm to make one revolution is $20\times\pi/465.2=0.135$ s. Since the time required for the photosensitive drum 1 to make one revolution is 0.27 s, even in this case, a relationship of an integral multiple holds, so that the advantageous effect of the first exemplary embodiment is able to be obtained.

In this way, if the ratio of the circumferential velocity of the developing sleeve 28 to the circumferential velocity of the photosensitive drum 1 (the developing sleeve circumferential velocity/photosensitive drum circumferential velocity) at the time of phase detection is made lower than that at the normal mode, there is an advantage of being able to increase the sensitivity for density variation unevenness.

If the ratio of the circumferential velocity of the developing sleeve 28 to the circumferential velocity of the photosensitive drum 1 (the developing sleeve circumferential velocity/photosensitive drum circumferential velocity) is made lower, the ability to supply toner to the photosensitive drum 1 decreases. Therefore, an influence obtained in a case where there is a variation in a gap between the developing sleeve 28 and the photosensitive drum 1 (SD gap) becomes likely to appear, so that the sensitivity for density variation unevenness becomes large. If the sensitivity for density variation unevenness becomes large, a detection misalignment becomes unlikely to occur.

In the above-described first exemplary embodiment, at the time of phase detection, the ratio of the rotation period of the photosensitive drum 1 to the rotation period of the developing sleeve 28 is set to a relationship of an integral multiple or one integer-th, and, at the time of normal image formation, the ratio of the rotation period of the photosensitive drum 1 to the rotation period of the developing sleeve 28 is prevented from being set to a relationship of an integral multiple or one integer-th. Specifically, at the time of the phase detection mode, making the ratio of the circumferential velocity of the developing sleeve 28 to the circumferential velocity of the photosensitive drum 1 different from that at the time of the normal mode enables increasing the noticeability at the time of phase detection and, on the other hand, enables preventing or reducing the noticeability at the time of normal image formation from being also increased. According to the first exemplary embodiment configured as described above, it is possible to, while increasing the detection accuracy for the phase (rotational angle) of the photosensitive drum or the developing sleeve in detecting a periodic image density unevenness, make a periodic image density unevenness at the time of normal image formation unlikely to be noticeable.

In the above-described first exemplary embodiment, a configuration which sets the ratio of the rotation period of the photosensitive drum 1 to the rotation period of the developing sleeve 28 to an integral multiple or one integer-th only at the time of phase detection, thus causing the interference (beat) of periodic image density unevennesses caused by the photosensitive drum 1 and the developing sleeve 28 to become regular and increasing the detection accuracy, has been described. While employing the configuration of the first exemplary embodiment enables increasing the detection accuracy, since the interference (beat) of periodic image density unevennesses still remains, the possibility of occurrence of a phase detection misalignment caused by that effect also remains.

Generally, the interference (beat) is likely to occur to a great extent when two periods are close to each other. On the other hand, when two periods are away from each other, a misalignment of peaks caused by the interference can be reduced. The maximum misalignment of peaks is roughly estimated as follows. In a case where the ratio of the rotation period of the photosensitive drum 1 to the rotation period of the developing sleeve 28 is 2.5 times, the maximum misalignment becomes 360°/2.5/2=72°, in a case where the ratio is 4 times, the maximum misalignment becomes 360°/4/2=45°, in a case where the ratio is 5 times, the maximum misalignment becomes 360°/5/2=36°, and in a case where the ratio is 8 times, the maximum misalignment becomes 360°/8/2=22.5°.

As explained above with reference to FIG. 10, as a phase detection misalignment becomes larger, the effect of density correction decreases.

As is understandable from FIG. 10, if a misalignment of 45° or more occurs, the phase detection misalignment becomes easily noticeable even by visual contact. To make a phase detection alignment smaller than 45°, setting the ratio of the rotation period of the photosensitive drum 1 to the rotation period of the developing sleeve 28 larger than 4 times enables keeping the phase detection alignment smaller than 45° at a maximum.

Therefore, a second exemplary embodiment is configured to set, only at the time of phase detection, the ratio of the rotation period of the photosensitive drum 1 to the rotation period of the developing sleeve 28 to 5 times. Specifically, while the circumferential velocity of the developing sleeve 28 at the time of normal image formation is 591.6 mm/s, the circumferential velocity of the developing sleeve 28 at the time of phase detection is set to 1,162 mm/s.

Since the diameter of the developing sleeve 28 in the second exemplary embodiment is 20 mm, the time required for the developing sleeve 28 to make one revolution is $20\times\pi/1162=0.054$ s. On the other hand, since the diameter of the photosensitive drum 1 in the second exemplary embodiment is 30 mm and the circumferential velocity thereof is 348 mm/s, the time required for the photosensitive drum 1 to make one revolution is $30\times\pi/348=0.27$ s. Accordingly, the second exemplary embodiment performs setting in such a manner that, at the time of phase detection, the developing sleeve 28 makes five revolutions during a period when the photosensitive drum 1 makes one revolution.

Figure 13:
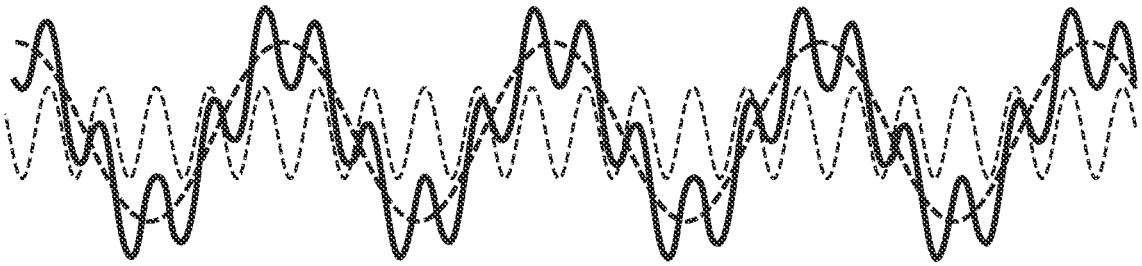
FIG. 13 is a schematic diagram illustrating, side by side, a detection signal obtained by an image density detection unit of an image forming apparatus according to a second exemplary embodiment of the present disclosure and density variations occurring at the photosensitive drum and the developing sleeve obtained by performing waveform separation of the detection signal.

A detection signal for density unevenness obtained at this time is illustrated with solid line in FIG. 13. FIG. 13 also illustrates, with dashed lines, respective density unevennesses of the photosensitive drum 1 and the developing sleeve 28 obtained by waveform separation. The dashed line with a short period indicates a density unevenness of the developing sleeve 28, and the dashed line with a long period indicates a density unevenness of the photosensitive drum 1. Comparing the solid line and dashed lines illustrated in FIG. 13 makes it seen that a misalignment of peaks is reduced to a relatively small one.

The larger the ratio of the rotation period of the photosensitive drum 1 to the rotation period of the developing sleeve 28, a misalignment of peaks by interference is able to be reduced to a smaller one. Therefore, more favorably, if the ratio is set to 8 times or more, the misalignment becomes able to be reduced to 22.5° or less. However, since there is a case where it becomes necessary to rotate the developing sleeve 28 at high speed depending on a configuration, in that case, if the ratio is set larger than 4 times, the advantageous effect of the present exemplary embodiment can be obtained.

Furthermore, the normal mode does not necessarily need to have the same velocity configuration as that at the time of phase detection, and it is favorable that the normal mode has a configuration adapted for image formation. For example, in the configuration of the second exemplary embodiment, at the time of phase detection, the ratio of the circumferential velocity of the developing sleeve 28 to the circumferential velocity of the photosensitive drum 1 (developing sleeve circumferential velocity/photosensitive drum circumferential velocity) is 334%. Usually, it is not necessary to rotate the developing sleeve 28 at so high speed, but rather the high speed rotation may also become a cause of deterioration of a developer or defect of an image. Therefore, the second exemplary embodiment is configured to set the ratio of the circumferential velocity of the developing sleeve 28 to the circumferential velocity of the photosensitive drum 1 (developing sleeve circumferential velocity/photosensitive drum circumferential velocity) to 170%.

A third exemplary embodiment is configured to make the rotational speed of the developing sleeve 28 at the time of phase detection of the photosensitive drum 1 in such a manner that, during a period when the photosensitive drum 1 makes one revolution, the developing sleeve 28 does not make one revolution.

Specifically, the circumferential velocity of the developing sleeve 28 is set to 193.8 mm/s. In this case, the time required for the developing sleeve 28 with a diameter of 20 mm to make one revolution is 0.324 s. Since the time required for the photosensitive drum 1 to make one revolution is 0.27 s, the developing sleeve 28 does not make one revolution during a period when the photosensitive drum 1 makes one revolution.

Figure 14:
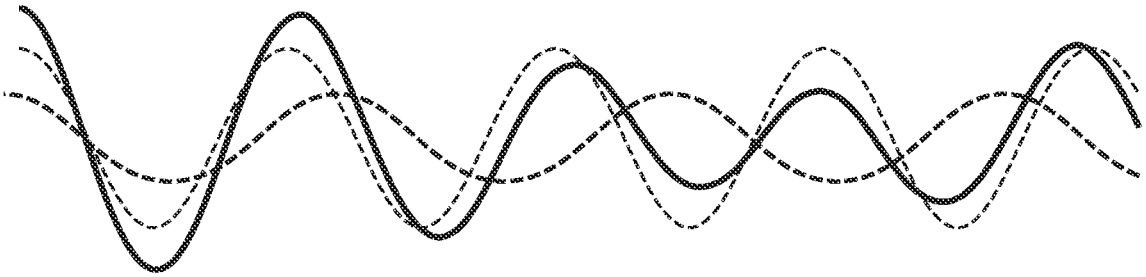
FIG. 14 is a schematic diagram illustrating, side by side, a detection signal obtained by an image density detection unit of an image forming apparatus according to a third exemplary embodiment of the present disclosure and density variations occurring at the photosensitive drum and the developing sleeve obtained by performing waveform separation of the detection signal.

A detection signal for density unevenness obtained at this time is illustrated with solid line in FIG. 14. FIG. 14 also illustrates, with dashed lines, respective density unevennesses of the photosensitive drum 1 and the developing sleeve 28 obtained by waveform separation. The dashed line with a long period indicates a density unevenness of the developing sleeve 28, and the dashed line with a short period indicates a density unevenness of the photosensitive drum 1. Comparing the solid line and dashed lines illustrated in FIG. 14 makes it seen that a misalignment of peaks between the detection signal and an unevenness of the photosensitive drum 1 is reduced to a relatively small one. In this way, as the pitch interval of the developing sleeve 28 becomes wider than the pitch interval of the photosensitive drum 1, although an influence of the peak intensity appears, an influence of the peak position becomes unlikely to appear. It is possible to reduce a phase detection misalignment of peaks of the pitch of the photosensitive drum 1 to a smaller one.

At the time of normal image formation, in many cases, the developing sleeve 28 is rotated at a speed higher than that of the photosensitive drum 1. This is because of supplying sufficient toner to a development region. Even in such cases, employing a configuration in which the rotational speed of the developing sleeve 28 is made lower only at the time of phase detection and the developing sleeve 28 does not make one revolution during a period when the photosensitive drum 1 makes one revolution enables reducing a phase detection misalignment of peaks of the pitch of the photosensitive drum 1 to a smaller one.

In the above-described first exemplary embodiment, second exemplary embodiment, and third exemplary embodiment, an example of preventing or reducing a density variation unevenness by increasing the detection accuracy of the phase (rotational angle) of the photosensitive drum 1 or the developing sleeve 28, avoiding the interference of periodic image density unevennesses, and thus reducing a detection misalignment has been described. However, in a case where the obtained density distribution data is a minute variation relative to the detection accuracy of the density detection method, that data may lie buried in noises and it may be impossible to accurately detect a density variation unevenness.

Therefore, a fourth exemplary embodiment is configured to, at the time of density variation unevenness detection, increase the sensitivity for periodic density variation to improve the detection accuracy and, at the time of normal image formation, set a condition for making a periodic density variation unnoticeable in a manner similar to those in the first to third exemplary embodiments, thus decreasing the noticeability. Furthermore, a modification example of performing density variation unevenness detection by a combination of the fourth exemplary embodiment and any one of the first to third exemplary embodiments can be employed.

Figure 15:
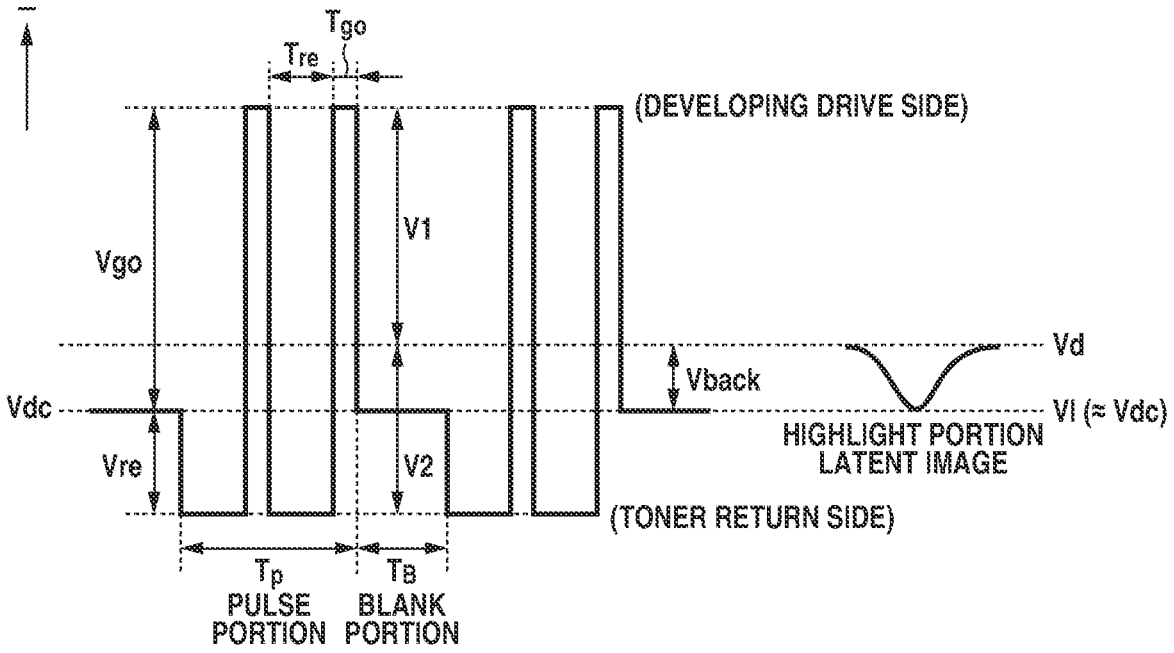
FIG. 15 is an outline waveform diagram of a developing bias according to a fourth exemplary embodiment of the present disclosure.

In the fourth exemplary embodiment, the method of increasing the sensitivity for density variation unevenness detection includes changing a developing bias which is applied to the developing sleeve 28 at the time of density variation unevenness detection. FIG. 15 is a diagram illustrating the waveform of a developing bias which the power source 30 of the developing device 4 according to the fourth exemplary embodiment outputs (the vertical axis being indicated in such a manner that the upper side means "minus"). The power source 30, which serves as a developing bias application unit, applies, to the developing sleeve 28, a developing bias in which an alternating-current component and a direct-current component of a rectangular wave are superposed on each other. In the fourth exemplary embodiment, the power source 30 applies a direct-current voltage of −500 volts (V) and an alternating-current voltage with a peak-to-peak voltage Vpp of 1,160 V and a frequency f of 12.6 kilohertz (kHz).

Generally, in a two-component magnetic brush developing method, if an alternating-current voltage is applied, the development efficiency increases and an image becomes highly definite, but, conversely, fogging becomes likely to occur. Therefore, a method of preventing fogging by setting a potential difference Vback (=|Vd−Vdc|) between a direct-current voltage Vdc which is applied to the developing sleeve 28 and a charging potential (i.e., a non-image portion surface potential) Vd of the photosensitive drum 1 is performed. In the fourth exemplary embodiment, the potential difference Vback is set as Vback=150 V. Thus, the non-image portion surface potential Vd of the photosensitive drum 1 is set as Vd=−650 V, and the direct-current voltage Vdc of the developing bias is set as Vdc=−500 V. Furthermore, the charging potential Vd of the photosensitive drum 1 differs between immediately after charging and the developing position because there is dark decay. Since the fourth exemplary embodiment is directed to development at the developing position, the charging potential Vd of the photosensitive drum 1 in the fourth exemplary embodiment is assumed to mean a value at the developing position. The same also applies to other potentials such as a latent image portion potential VL of the photosensitive drum 1.

The developing bias in the fourth exemplary embodiment is a blank pulse waveform in which a portion which has become only a direct-current voltage by an alternating-current voltage being intermittently thinned out is provided. In the present specification, a portion on which an alternating-current voltage has been superposed is referred to as a "pulse portion", and a portion which has become only a direct-current voltage by an alternating-current voltage being thinned out is referred to as a "blank portion". Additionally, a developing bias waveform in which there is no thinning-out of an alternating-current voltage (no blank portion) is referred to as a "rectangular waveform".

The fourth exemplary embodiment is configured to, at the time of normal image formation, apply the above-mentioned blank pulse waveform and, at the time of density variation unevenness detection, apply only a direct-current component with an alternating-current component removed. As an image available for evaluating or detecting a density variation unevenness, a solid image with an optical density of about OD=1.4 was used, and evaluation or detection was performed with a solid image with a length of about 200 mm longer than the period of the developing sleeve 28 or the photosensitive drum 1 in the sub-scanning direction.

Figure 16:
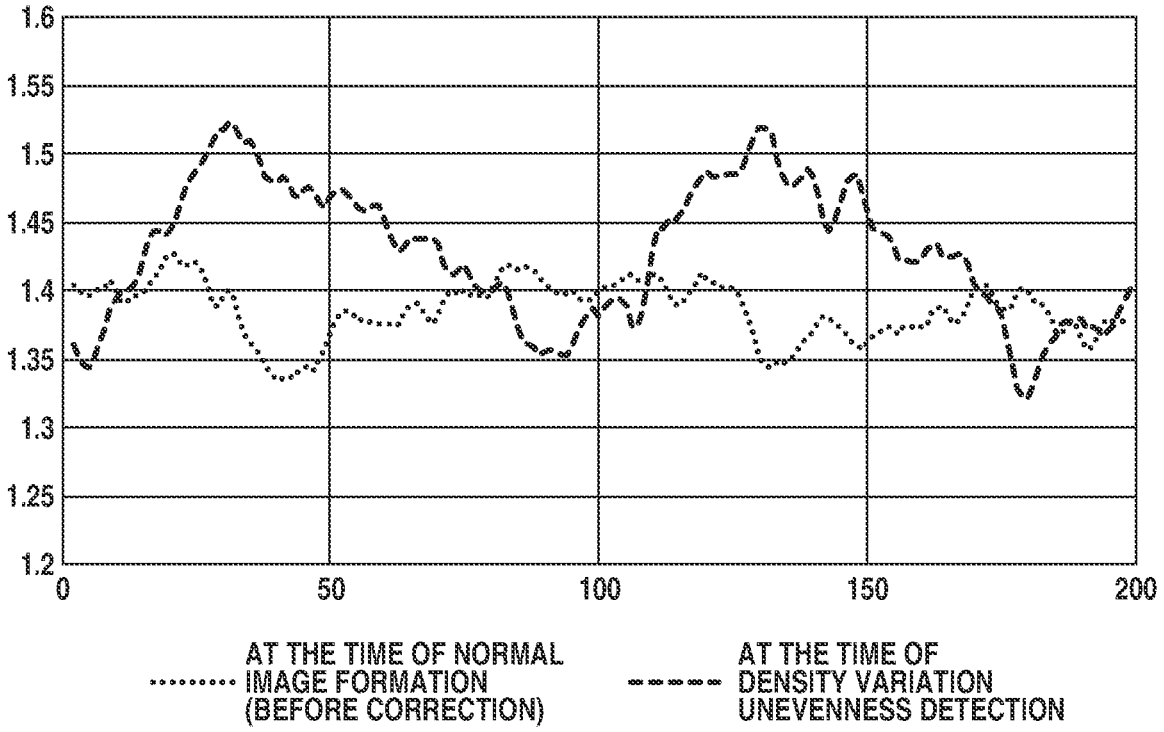
FIG. 16 is a diagram illustrating detection results obtained on different developing bias conditions by an image density detection unit of an image forming apparatus according to the fourth exemplary embodiment of the present disclosure.
Figure 17:
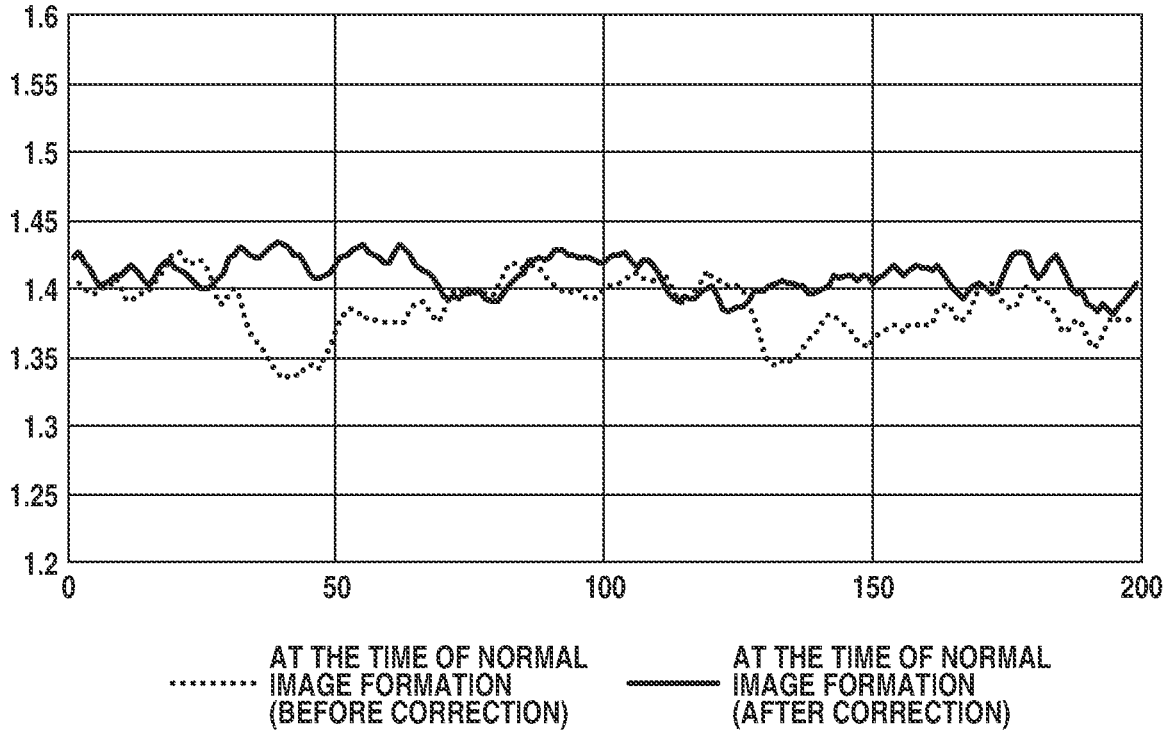
FIG. 17 is a diagram illustrating a correction detection result obtained by the image density detection unit of the image forming apparatus according to the fourth exemplary embodiment of the present disclosure.

FIG. 16 illustrates density distribution data obtained at the time of normal image formation and density distribution data obtained at the time of density variation unevenness detection with only a direct-current component applied with respect to the above-mentioned solid image. As is understandable from FIG. 16, the density distribution data obtained at the time of density variation unevenness detection has a larger peak value than that at the time of normal image formation, and has a sufficiently large amplitude relative to noises, thus being able to be used to accurately obtain pitch information. Moreover, a density variation unevenness such as that illustrated in FIG. 17 was able to be prevented or reduced by performing phase detection and applying a density correction value in the method mentioned above with reference to, for example, FIG. 8 based on the obtained pitch information.

Here, the reason why the sensitivity for density variation unevenness was able to be increased by applying only a direct-current component to the developing bias is described. This is because, in the case of using only a direct-current component, the electric field strength is lower and the ability of supplying toner to the photosensitive drum 1 is more likely to vary than in the case of using a direct-current component with an alternating-current component superposed thereon. Thus, in a case where there is a variation in a gap between the developing sleeve 28 and the photosensitive drum 1 (SD gap), in the case of using a developing bias including only a direct-current component, the ability of supplying toner decreases when the SG gap is large. On the other hand, when the SD gap is small, since the ability of supplying toner increases, the amplitude of a density distribution becomes large as a difference between a decrease and increase of the ability.

Thus, it can be said that, to make the sensitivity for density variation unevenness at the time of density variation unevenness detection, it is favorable to lower an electric field strength between the developing sleeve 28 and the photosensitive drum 1 to totally decrease the development efficiency. Accordingly, not only in the case of a developing bias including only a direct-current component but also in the case of a developing bias with an alternating-current component superposed on a direct-current component, it is also possible to decrease the development efficiency by a method described below. For example, the development efficiency is also able to be decreased by changing a developing bias in a direction to make a voltage Vgo (see FIG. 15) smaller by lowering the peak-to-peak voltage Vpp at the time of density variation unevenness detection or by changing the ratio between the voltage Vgo and a voltage Vre (see FIG. 15). Moreover, the development efficiency is also able to be decreased by increasing a time or the number of times for which the developing bias is at the voltage Vre by changing a frequency of the pulse portion or the length of the blank portion.

Next, a method of increasing the detection accuracy by a method of decreasing the development efficiency using other than a developing bias is described. Furthermore, each of methods of relatively decreasing the development efficiency using other than a developing bias can be combined with a method of relatively decreasing the development efficiency using a developing bias as appropriate. For example, there is a method of making the image density at the time of density variation unevenness detection higher than at the time of normal image formation. While the density of a solid image is OD=1.4 at the time of normal image formation, for example, the density variation unevenness detection is performed with a developing contrast (Vcont) increased and the optical density raised to OD=1.6.

Figure 18:
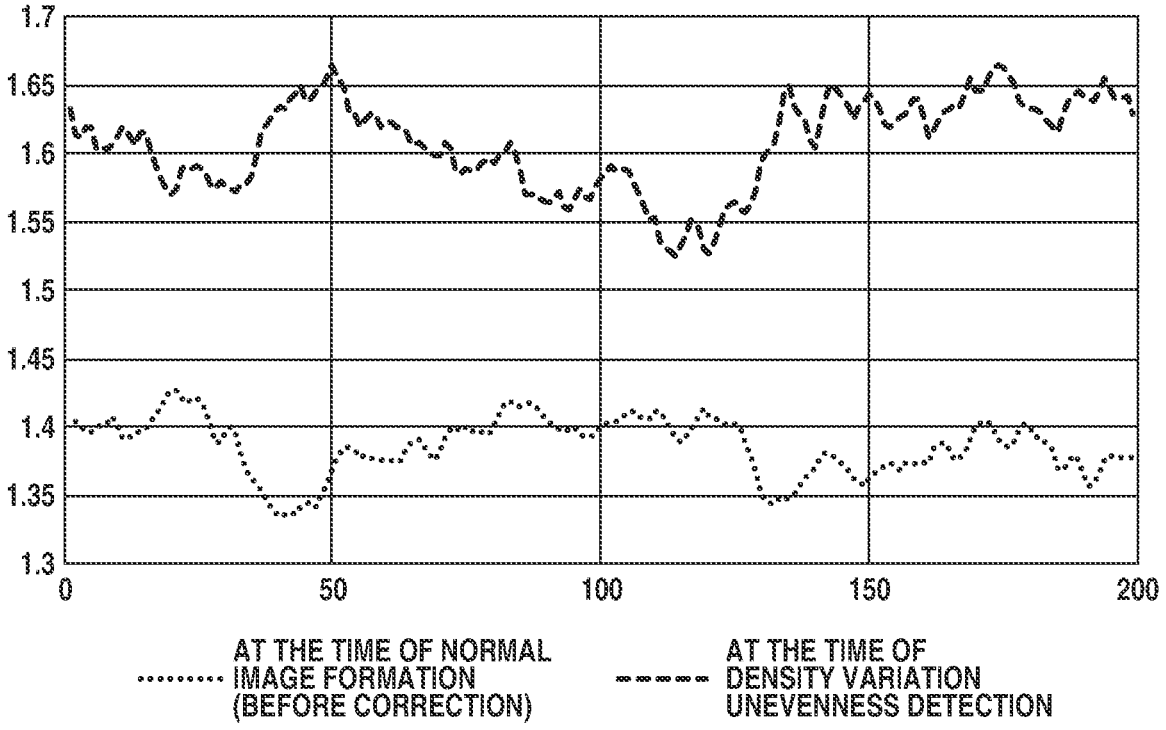
FIG. 18 is a diagram illustrating detection results obtained with different solid image densities by the image density detection unit of the image forming apparatus according to the fourth exemplary embodiment of the present disclosure.

FIG. 18 illustrates density distribution data obtained at that time. As is understandable from FIG. 18, it can be seen that, due to the optical density raised to OD=1.6, the amplitude (Dpp) of this periodic density variation has become larger.

When OD=1.4, Dpp=0.09, and
when OD=1.6, Dpp=0.14.

This enables increasing the detection accuracy. Furthermore, the reason why the development efficiency is relatively decreased by raising the aimed optical density OD is that, since the amount of toner to be supplied from the developing sleeve 28 to the photosensitive drum 1 increases, the sensitivity becomes higher with respect to an SD gap variation. Thus, since, when the SD gap is large, the ability of supplying toner becomes more insufficient and the density decreases as compared with when the SD gap is small, the amplitude of a density distribution becomes large as a difference thereof. This enables making the amplitude sufficiently large with respect to noises and thus enables accurately obtaining pitch information.

Furthermore, while, thus far, density variation unevenness detection is performed with use of a solid image, an image to be used for detection is not limited to a solid image. Moreover, besides the above-mentioned detection on an output product to a sheet of paper, a toner image formed on the photosensitive drum 1 can be detected, or a toner image formed on the intermediate transfer belt 5 can be detected.

Furthermore, an optical sensor which detects a toner image formed on the photosensitive drum 1 or the intermediate transfer belt 5 has a tendency of being low in sensitivity at the shadow side of a solid image as compared with halftone of a halftone image. Therefore, in the case of detecting a toner image formed on the photosensitive drum 1 or the intermediate transfer belt 5, using a halftone image for detection can be considered. At that time, while, in the fourth exemplary embodiment, an image for use at the time of normal image formation is a screen image with 170 lines per inch, this is changed at the time of density variation unevenness detection. Here, detection is performed with analog halftone in such a manner that the sensitivity for density variation unevenness increases. In the analog halftone, unlike a screen image for use at the time of normal image formation, a dot latent image is not formed and the potential on the photosensitive drum 1 is uniform as with a solid image, but the potential difference Vcont thereof is small as compared with a solid image. Therefore, a latent image is shallow and the sensitivity for density variation unevenness becomes higher with respect to a gap variation.

Figure 19:
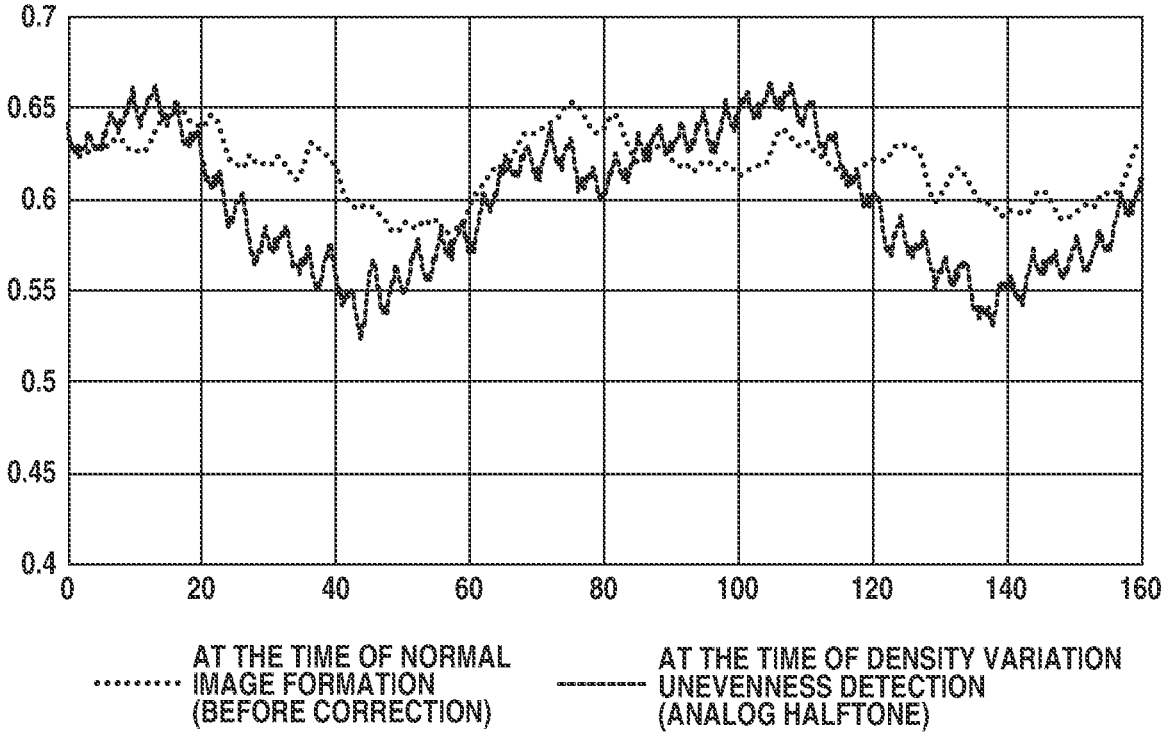
FIG. 19 is a diagram illustrating detection results obtained on different halftone conditions by the image density detection unit of the image forming apparatus according to the fourth exemplary embodiment of the present disclosure.

In the fourth exemplary embodiment, while the potential difference Vcont for obtaining the image density OD=1.4 is about 200 V, the potential difference Vcont for obtaining the image density OD=0.6 is 30 V. FIG. 19 illustrates a result obtained by detecting a toner image on the intermediate transfer belt 5 with use of this image at the time of detection. Performing detection with use of an image formed with analog halftone enables making the amplitude of density variation larger than performing detection on a condition used at the time of normal image formation. This enables making the amplitude sufficiently large with respect to noises and thus enables accurately obtaining pitch information. In this way, analog halftone can be used for a detection image, or a screen image with a higher number of lines per inch than a screen image with 170 lines per inch or an error-diffused screen image can be used. These all are image forming conditions changed in such a manner that a latent image for dots becomes shallow as compared with a screen image used at the time of normal image formation.

The present disclosure is not limited to the above-described exemplary embodiments, but can be modified in various manners (including an organic combination of some of the exemplary embodiments) based on the gist of the present disclosure, and such modifications should not be excluded from the scope of the present disclosure.

While, in the above-described exemplary embodiments, an image forming apparatus having a configuration using the intermediate transfer belt 5 as illustrated in FIG. 1 has been described as an example, the exemplary embodiments are not limited to this. The present disclosure can be applied to an image forming apparatus having a configuration in which transfer is performed by causing a recording material S to come into direct contact with photosensitive drums 1 in sequence.

While the present disclosure has been described with reference to exemplary embodiments, it is to be understood that the present disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2021-131200 filed Aug. 11, 2021, which is hereby incorporated by reference herein in its entirety.

What is claimed is:

1. An image forming apparatus comprising:

a rotatable image bearing member configured to allow an electrostatic image to be formed thereon;

an image forming unit including an exposure device configured to expose the image bearing member to form an electrostatic image on the image bearing member and a developing device including a development container accommodating a developer and a rotatable developer bearing member configured to bear the developer thereon to develop an electrostatic image formed on the image bearing member;

a developing bias application unit configured to apply a developing bias to the developer bearing member;

a first phase detection unit configured to detect a phase of the image bearing member;

a second phase detection unit configured to detect a phase of the developer bearing member;

a controller configured to control the image forming unit in such a way as to form a toner pattern; and an image density detection unit configured to detect an image density of the toner pattern formed by the image forming unit, wherein the controller is able to, in a case where the controller receives a correction instruction for image density, execute a phase detection mode for detecting a phase of the image bearing member by the first phase detection unit and detecting a phase of the developer bearing member by the second phase detection unit and execute a toner pattern forming operation for forming the toner pattern, and change an image forming condition for the image forming unit during an image formation mode based on respective phases of the image bearing member and the developer bearing member detected in the phase detection mode and an image density of the toner pattern detected by the image density detection unit, and wherein a ratio of a circumferential velocity of the developer bearing member to a circumferential velocity of the image bearing member during the phase detection mode is smaller than a ratio of a circumferential velocity of the developer bearing member to a circumferential velocity of the image bearing member during the image formation mode, and wherein the circumferential velocity of the developer bearing member during the toner pattern forming operation is equal to the circumferential velocity of the developer bearing member during the image formation mode, and the circumferential velocity of the image bearing member during the toner pattern forming operation is equal to the circumferential velocity of the image bearing member during the image formation mode.

2. The image forming apparatus according to claim 1, wherein the circumferential velocity of the developer bearing member during the phase detection mode is lower than the circumferential velocity of the developer bearing member during the image formation mode.

3. The image forming apparatus according to claim 1, wherein the circumferential velocity of the image bearing member during the phase detection mode is equal to the circumferential velocity of the image bearing member during the image formation mode.

4. The image forming apparatus according to claim 1, wherein a ratio of a rotation period of the developer bearing member to a rotation period of the image bearing member during the phase detection mode is approximately an integral multiple.

5. The image forming apparatus according to claim 1, wherein a ratio of a rotation period of the developer bearing member to a rotation period of the image bearing member during the phase detection mode is approximately one integer-th.

6. The image forming apparatus according to claim 1, wherein a developing bias which is applied to the developer bearing member by the developing bias application unit during the phase detection mode includes only a direct-current component.

7. The image forming apparatus according to claim 1, wherein an electric field strength of a developing bias which is applied to the developer bearing member by the developing bias application unit during the phase detection mode is smaller than an electric field strength of a developing bias which is applied to the developer bearing member by the developing bias application unit during the image formation mode.

8. The image forming apparatus according to claim 1, wherein a frequency of a developing bias which is applied to the developer bearing member by the developing bias application unit during the phase detection mode is larger than a frequency of a developing bias which is applied to the developer bearing member by the developing bias application unit during the image formation mode.

9. The image forming apparatus according to claim 1, wherein the image forming condition is an exposure condition on which to expose the image bearing member by the exposure device.

10. The image forming apparatus according to claim 1, wherein the image forming condition is a bias condition on which to apply a developing bias to the developer bearing member by the developing bias application unit.

11. An image forming apparatus comprising:

a rotatable image bearing member configured to allow an electrostatic image to be formed thereon;

an image forming unit including an exposure device configured to expose the image bearing member to form an electrostatic image on the image bearing member and a developing device including a development container accommodating a developer and a rotatable developer bearing member configured to bear the developer thereon to develop an electrostatic image formed on the image bearing member;

a developing bias application unit configured to apply a developing bias to the developer bearing member;

a first phase detection unit configured to detect a phase of the image bearing member;

a second phase detection unit configured to detect a phase of the developer bearing member;

a controller configured to control the image forming unit in such a way as to form a toner pattern; and an image density detection unit configured to detect an image density of the toner pattern formed by the image forming unit, wherein the controller is able to, in a case where the controller receives a correction instruction for image density, execute a phase detection mode for detecting a phase of the image bearing member by the first phase detection unit and detecting a phase of the developer bearing member by the second phase detection unit and execute a toner pattern forming operation for forming the toner pattern, and change an image forming condition for the image forming unit during an image formation mode based on respective phases of the image bearing member and the developer bearing member detected in the phase detection mode and an image density of the toner pattern detected by the image density detection unit, and wherein a ratio of a circumferential velocity of the developer bearing member to a circumferential velocity of the image bearing member during the phase detection mode is larger than a ratio of a circumferential velocity of the developer bearing member to a circumferential velocity of the image bearing member during the image formation mode, and wherein the circumferential velocity of the developer bearing member during the toner pattern forming operation is equal to the circumferential velocity of the developer bearing member during the image formation mode, and the circumferential velocity of the image bearing member during the toner pattern forming operation is equal to the circumferential velocity of the image bearing member during the image formation mode.

12. The image forming apparatus according to claim 11, wherein the circumferential velocity of the developer bearing member during the phase detection mode is higher than the circumferential velocity of the developer bearing member during the image formation mode.

13. The image forming apparatus according to claim 11, wherein the circumferential velocity of the image bearing member during the phase detection mode is equal to the circumferential velocity of the image bearing member during the image formation mode.

14. The image forming apparatus according to claim 11, wherein a ratio of a rotation period of the developer bearing member to a rotation period of the image bearing member during the phase detection mode is approximately an integral multiple.

15. The image forming apparatus according to claim 11, wherein a ratio of a rotation period of the developer bearing member to a rotation period of the image bearing member during the phase detection mode is approximately one integer-th.

16. The image forming apparatus according to claim 11, wherein a developing bias which is applied to the developer bearing member by the developing bias application unit during the phase detection mode includes only a direct-current component.

17. The image forming apparatus according to claim 11, wherein an electric field strength of a developing bias which is applied to the developer bearing member by the developing bias application unit during the phase detection mode is smaller than an electric field strength of a developing bias which is applied to the developer bearing member by the developing bias application unit during the image formation mode.

18. The image forming apparatus according to claim 11, wherein a frequency of a developing bias which is applied to the developer bearing member by the developing bias application unit during the phase detection mode is larger than a frequency of a developing bias which is applied to the developer bearing member by the developing bias application unit during the image formation mode.

19. The image forming apparatus according to claim 11, wherein the image forming condition is an exposure condition on which to expose the image bearing member by the exposure device.

20. The image forming apparatus according to claim 11, wherein the image forming condition is a bias condition on which to apply a developing bias to the developer bearing member by the developing bias application unit.

* * * * *